US006698629B2

(12) United States Patent
Taylor-McCune

(10) Patent No.: US 6,698,629 B2
(45) Date of Patent: Mar. 2, 2004

(54) COMESTIBLE FLUID DISPENSING TAP AND METHOD

(75) Inventor: Christopher J. Taylor-McCune, Mission Viejo, CA (US)

(73) Assignee: SHURflo Pump Manufacturing Co., Inc., Cypress, CA (US)

( * ) Notice: Subject to any disclaimer, the term of this patent is extended or adjusted under 35 U.S.C. 154(b) by 0 days.

(21) Appl. No.: 09/853,077

(22) Filed: May 10, 2001

(65) Prior Publication Data

US 2002/0166880 A1 Nov. 14, 2002

(51) Int. Cl.[7] ..... B65D 25/40

(52) U.S. Cl. ..... 222/571; 222/383.1; 222/108; 239/119

(58) Field of Search ..... 222/571, 383.1, 222/108, 334; 239/119

(56) References Cited

U.S. PATENT DOCUMENTS

| | | | | | |
|---|---|---|---|---|---|
| 262,183 | A | | 8/1882 | Hogan | |
| 1,395,442 | A | | 11/1921 | MacGregor | |
| 1,667,943 | A | | 3/1928 | Munz | |
| 1,713,357 | A | | 5/1929 | St. Clair | |
| 1,767,354 | A | * | 6/1930 | Eastes | 417/392 |
| 3,539,112 | A | | 11/1970 | Thompson | |
| 3,547,148 | A | * | 12/1970 | Moshe | 137/540 |
| 3,726,482 | A | | 4/1973 | Heinrichs | |
| 3,756,233 | A | | 9/1973 | Goldowsky | |
| 3,788,353 | A | | 1/1974 | Breunsbach | |
| 3,902,665 | A | * | 9/1975 | Hendry | 239/119 |
| 4,154,402 | A | | 5/1979 | Fletcher | |
| 4,372,354 | A | | 2/1983 | Moore | |
| 4,394,945 | A | * | 7/1983 | Taylor, Jr. | 222/571 |
| 4,396,044 | A | * | 8/1983 | Ahlers | 141/90 |
| 4,477,003 | A | | 10/1984 | Baker et al. | |
| 4,597,719 | A | * | 7/1986 | Tano | 417/317 |
| 4,958,669 | A | * | 9/1990 | Ohta | 141/311 |
| 4,990,746 | A | * | 2/1991 | Hammond | 392/441 |
| 5,016,687 | A | * | 5/1991 | Kawamura | 141/116 |
| 5,056,686 | A | * | 10/1991 | Jarrett | 222/129.2 |
| 5,094,278 | A | * | 3/1992 | Arao et al. | 141/311 |

(List continued on next page.)

OTHER PUBLICATIONS

Website pages "Welcome to the Home of Wunder–Bar Dispensing Systems"; *www.wunderbar.com*; May 19, 2000. Website pages "Cornelius Online" "Pumpsmart condiment Dispensers"; *www.cornelius.com* May 19, 2000.

(List continued on next page.)

*Primary Examiner*—Gene Mancene
*Assistant Examiner*—Frederick C. Nicolas
(74) *Attorney, Agent, or Firm*—Michael Best & Friedrich LLP

(57) ABSTRACT

The comestible fluid dispensing system of the present invention preferably employs a pump or valve operable to control movement of comestible fluid from a comestible fluid source to a tap provided with a draw-back valve. The draw-back valve is preferably capable of drawing comestible fluid in an upstream direction in the tap during closure of the draw-back valve. Preferably, suction generated by closure of the draw-back valve is employed for one or more purposes including: to remove comestible fluid dangling from the tap, to draw comestible fluid into the tap away from view and from exposure to the environment, to reduce comestible fluid buildup on and near the tap outlet, to enclose or at least partially enclose comestible fluid downstream of the draw-back valve, and to operate a downstream cutoff valve in the tap. A damper is employed in some embodiments to control valve movement.

80 Claims, 10 Drawing Sheets

U.S. PATENT DOCUMENTS 5,113,753 A 5/1992 Robinson
5,158,210 A 10/1992 Du
5,169,292 A 12/1992 Loubier et al.
5,193,593 A * 3/1993 Denis et al. ..... 141/10
5,230,443 A 7/1993 Du
5,297,945 A 3/1994 Loubier et al.
5,350,083 A 9/1994 Du
5,361,943 A 11/1994 Du
5,364,244 A 11/1994 Taylor-McCune et al.
5,366,117 A 11/1994 Mesenbring et al.
5,368,195 A 11/1994 Pleet et al.
5,395,046 A 3/1995 Knobbe et al.
5,427,144 A * 6/1995 Teets et al. ..... 137/614.2
5,429,304 A * 7/1995 Tomita et al. ..... 239/119
5,429,308 A 7/1995 Brown
5,429,681 A 7/1995 Mesenbring
5,431,343 A 7/1995 Kubiak et al.
5,435,466 A 7/1995 Du
5,540,774 A 7/1996 Smitherman
5,542,574 A 8/1996 Stern
5,553,740 A 9/1996 King et al.
5,566,863 A 10/1996 Mesenbring et al.
5,622,484 A 4/1997 Taylor-McCune et al.
5,624,056 A 4/1997 Martindale
5,641,096 A 6/1997 Robbins et al.
5,643,195 A * 7/1997 Drevet et al. ..... 604/9
5,645,116 A * 7/1997 McDonald ..... 141/208
5,667,105 A 9/1997 Hartley et al.
5,704,522 A * 1/1998 Orgeolet et al. ..... 222/494
5,720,433 A * 2/1998 Forker ..... 239/119
D401,477 S 11/1998 Martindale
5,875,930 A 3/1999 Nakajima et al.
5,887,768 A * 3/1999 Price et al. ..... 222/571
5,906,296 A * 5/1999 Martindale et al. ..... 222/108
5,944,259 A 8/1999 Brown
5,947,800 A 9/1999 Fring
5,950,867 A 9/1999 Martindale et al.
5,992,695 A 11/1999 Start
5,992,764 A 11/1999 Bougamont et al.
5,996,846 A 12/1999 Martindale
6,029,903 A * 2/2000 Fukano et al. ..... 239/119
6,036,166 A 3/2000 Olson
6,058,986 A 5/2000 Bethuy et al.
6,082,587 A 7/2000 Martindale et al.
6,131,766 A 10/2000 King et al.
6,357,632 B1 * 3/2002 Salmela ..... 222/334
6,481,645 B1 * 11/2002 Taylor-McCune et al. .. 239/461

OTHER PUBLICATIONS

Product Brochure, "Hunt's Pumpable Condiments", Hunt–Wesson, Inc. 1997.
Product Brochure, "Introducing SAUCEflo Powered Condiment Dispense Systems", SHURflo Pump Manufacturing Co. (undated).
Product Brochure, "Arby's Sauce System" SHURflo Pump Manufacturing Co.; 8/99.
Product Brochure, "Powered Condiment Dispensing Cart" SHURflo Pump Manufacturing Co.; 8/99.
Product Brochure, "Powered Condiment Dispense Systems" SHURflo Pump Manufacturing Co.; 12/99.
Product Brochure, "SHURflo Powered Condiment Dispense Systems" SHURflo Pump Manufacturing Co.; Jan. 1, 2000.

* cited by examiner

COMESTIBLE FLUID DISPENSING TAP AND METHOD

FIELD OF THE INVENTION

The present invention relates to fluid dispensers, and more particularly to comestible fluid dispensing taps and methods of dispensing comestible fluid from such taps.

BACKGROUND OF THE INVENTION

A large number of comestible fluid dispensing systems and taps exist, most of which are adapted to dispense a particular type of comestible fluid. For example, some systems and taps are well-suited for dispensing relatively low-viscosity comestible fluids such as beer, soda, and other beverages, while other systems and taps are designed for dispensing more viscous comestible fluids such as ketchup, mustard, relish, mayonnaise, and other condiments. These latter comestible fluids often present unique problems for condiment dispensing systems and taps due to their higher viscosity. For example, relatively viscous condiments hang from a tap after dispense. This not only presents an unappealing appearance to later users of the tap, but also increases the chance that the dangling condiment will spoil before being used. Either result can significantly lower the desirability of the condiment and can therefore negatively impact condiment sales. Although the chances for hanging condiment is greater with higher viscosity fluids, the problems just described are relevant for virtually every comestible fluid (and are addressed by the present invention as described below).

Conventional comestible fluid dispensing systems and taps also address comestible fluid drip problems in varying ways and with varying success. Comestible fluid dripping between dispenses is undesirable for obvious reasons, and can be dependent upon the type of comestible fluid being dispensed.

A number of conventional devices and methods exist for addressing dangling comestible fluid and dripping problems described above. For example, the condiment dispensing system disclosed in U.S. Pat. No. 5,624,056 issued to Martindale employs a movable valve element which swipes the nozzle of the tap to remove excess condiment therefrom. In U.S. Pat. Nos. 6,082,587 and 5,906,266 issued to Martindale et al., a valve is used to reverse condiment flow at the end of condiment dispense to pull condiment on the nozzle back into the nozzle.

Conventional devices and method used for preventing comestible fluid buildup, dangling, and drips on a tap nozzle have a number of significant limitations. Typically, such devices and methods only partially protect against comestible fluid spoilage because comestible fluid that has exited the tap or nozzle is often still partially or fully exposed to the outside environment (although not always visible to a user). Also, such devices and methods employ relatively complex mechanisms for performing their tasks to prevent comestible fluid buildup, dangling, and drips. These mechanisms can therefore can be expensive to manufacture, assemble, and maintain, thereby adding to dispensing system and tap cost.

As mentioned above, some conventional devices and systems employ a drawback valve to draw comestible fluid back into the tap or nozzle after a dispense. A problem with such devices and systems is that the draw-back valve adds yet another component to the comestible fluid dispenser, requiring additional comestible fluid lines and connections, significantly adding to the total cost of the dispenser, and increasing system complexity. Furthermore, the draw-back valve in these dispensers is a separate device located a distance from the tap and connected to the tap often by two or more fluid lines. Therefore, the ability to control the draw-back force and the amount of comestible fluid drawn back by the valve is limited.

The required draw-back force and the resulting amount of drawn comestible fluid can vary greatly from fluid to fluid (often dependent at least in part upon comestible fluid viscosity and other comestible fluid properties). Lack of draw-back control can present problems when the same dispensing system and draw-back valve is employed to dispense different types of comestible fluids. Problems include drawing in air with the comestible fluid using too much drawing force from the draw-back valve and not providing sufficient force to draw comestible fluid back into the tap or nozzle.

In light of the problems and limitations of the prior art described above, a need exists for a comestible fluid dispensing apparatus, tap, and method which is well-suited for dispensing different types of comestible fluids, reduces or preferably eliminates comestible fluid buildup and dangling comestible fluid from nozzles and taps, prevents dripping, reduces exposure of comestible fluid to the environment between dispenses, is relatively simple in construction, assembly, and maintenance, is inexpensive and adds little to no cost to a conventional comestible fluid dispensing system or tap, and permits increased control over comestible fluid draw-back. Each preferred embodiment of the present invention achieves one or more of these results.

SUMMARY OF THE INVENTION

In one preferred embodiment of the present invention, the dispensing apparatus includes a pump operable to pump comestible fluid from a comestible fluid source to a tap provided with a draw-back valve. In some embodiments, the pump can be manually operated or can be powered by a motor or other conventional driving device, while other embodiments do not employ a pump but instead control the flow of comestible fluid under pressure to the tap. In the latter embodiments, flow to the tap can be controlled by an upstream valve.

The tap of the present invention is preferably provided with a draw-back valve capable of drawing comestible fluid in an upstream direction in the tap. Preferably, suction generated by closure of the draw-back valve is employed for one or more purposes including: to remove any comestible fluid dangling from the tap, to draw comestible fluid into the tap away from view and from exposure to the environment, to reduce comestible fluid buildup on and near the tap outlet, to enclose or at least partially enclose comestible fluid downstream of the draw-back valve, and to operate a downstream cutoff valve in the tap.

The draw-back valve is preferably a plunger valve, although other types of valves known in the art can generate sufficient suction force to perform the functions just described. The draw-back valve is movable between opened and closed positions, and more preferably is movable between at least one open position and a range of closed positions. As used herein and in the appended claims the term "valve" refers to that element or mechanism that is movable to enable and stop fluid flow out of the tap in different positions of the valve. For example, the draw-back valve in some preferred embodiments is a plunger valve as mentioned above. In such cases, the plunger valve refers to the plunger itself, and not to the passage through which the plunger moves or the seat (if any) against which the plunger stops when fully closed.

Some highly preferred embodiments employ a draw-back valve that moves through a passage having a substantially constant cross sectional area, a cross sectional area that increases in the downstream direction, or a passage having a portion with a substantially constant cross sectional area and a portion having an increasing cross sectional area in the downstream direction. The draw-back valve need not move fully through the passage (or passage portions), but moves sufficiently to produce the suction force described above. The size of the passage with respect to the draw-back valve, the shape of the passage and passage portions, the distance the draw-back valve moves in the passage (or passage portions), and the speed at which the draw-back valve moves are preferably selected to provide the desired suction force.

In one highly preferred embodiment, the closing draw-back valve moves first at least partially through a passage portion having a passage portion having an increasing cross sectional area in the downstream direction and then through a passage portion having a substantially constant cross sectional area. The valve is preferably sized to match the size of the passage portion having the substantially constant cross sectional area, and more preferably has a sliding seal with the walls of this passage portion. Other embodiments have a clearance between the walls of this passage portion and the valve. The amount of clearance (if any) is preferably dependent at least partially upon the type of comestible fluid being dispensed and the desired amount of suction force downstream of the valve.

The walls of the passage portion having an increasing cross sectional area in the downstream direction can be selected so that suction force is generated when the draw-back valve moves through this passage portion. Otherwise, these walls can be shaped so that suction force is primarily generated only when the valve moves through the passage portion having a substantially constant cross sectional area.

Any combination of passage portions with any desired shape and in any desired order (with respect to draw-back valve movement) can be employed, each preferably having at least one portion in which suction force is generated when the draw-back valve moves therethrough when closing.

Some preferred embodiments of the tap employ a shield near the tap outlet (downstream of the draw-back valve if used). This shield can comprise a wall that is preferably apertured to permit passage of comestible fluid therethrough, and can be made of a resilient relatively non-deformable or deformable material. The shield is preferably movable in the tap either by being deformable under comestible fluid pressure upstream of the shield or by being connected within the tap to shift or slide in the tap under such pressure. In either case, pressure changes upstream of the shield preferably generate some type of movement of the shield. This movement in either an upstream or downstream direction preferably dislodges comestible fluid that may be dangling from the tap, the downstream face of the shield, or a nozzle defining the tap outlet.

In some highly preferred embodiments, the shield is part of a cutoff valve which also has a cutoff valve seat located in the tap adjacent to the shield. Preferably, the shield is biased (inherently by its structure or by one or more biasing elements) into a closed position in which the aperture in the shield is plugged by the cutoff valve seat. The shield can be assisted to this position by suction generated by the draw-back valve during closing, in which case a reduced pressure can be maintained between the draw-back and cutoff valves. This reduced pressure helps to prevent opening of the cutoff valve between dispenses, either from the weight of upstream comestible fluid or from shock, jostling, or other movement of the tap.

By employing a cutoff valve as just described, comestible fluid which has not yet exited the tap or which has been drawn back into the tap by the draw-back valve can be retained in a sealed or substantially sealed portion of the tap. This comestible fluid is therefore protected from the tap environment and is less susceptible to drying or spoilage. Although the cutoff valve need not necessarily be employed with the draw-back valve, the two valves can be used together to draw leftover comestible fluid back into the tap through the cutoff valve, to then close or substantially close this comestible fluid in the tap, and to dislodge any other leftover comestible fluid from the outlet, nozzle, and/or cutoff valve.

The draw-back valve of the present invention is preferably biased toward a closed position by one or more springs or other conventional biasing elements or mechanisms. To control movement of and/or bias the draw-back valve, the draw-back valve can be connected to a movable wall which defines part of a chamber in the tap. The movable wall is preferably a damper which is sized to provide a sliding seal within the walls of the tap, to provide resistance to movement by frictional contact with these walls, or to perform both of these functions. Therefore, the damper preferably dampens and controls valve movement and can bias the valve toward a closed position by the reduced pressure in the chamber when the damper is moved with the valve to enlarge the chamber.

It should be noted that the present invention can be used to dispense any comestible fluid that can flow under pressure or otherwise. By way of example only, such comestible fluids include water, soda, beer, juices and other drinks, ketchup, mayonnaise, mustard, relish, sauce, syrup, dressing, and other condiments, soup, dough, filling, icing, and other food products, and the like.

The draw-back valve and the tap valve are preferably the same in the present invention. Therefore, one-tap valve in the present invention performs the same functions as two valves in conventional systems. In addition, the draw-back valve is part of the tap and is not an additional part that must be connected within the dispensing system upstream of the tap. Because the draw-back valve is in or part of the tap and is therefore preferably located relatively close to the tap outlet, better draw-back control is possible (as opposed to draw-back valves located a distance upstream of tap). Also, the tap of the present invention can readily by employed with existing comestible fluid dispensing systems. The draw-back valve of the present invention is easy to assemble, has fewer parts, and is therefore less costly to manufacture and maintain than conventional dispensing systems Further objects and advantages of the present invention, together with the organization and manner of operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
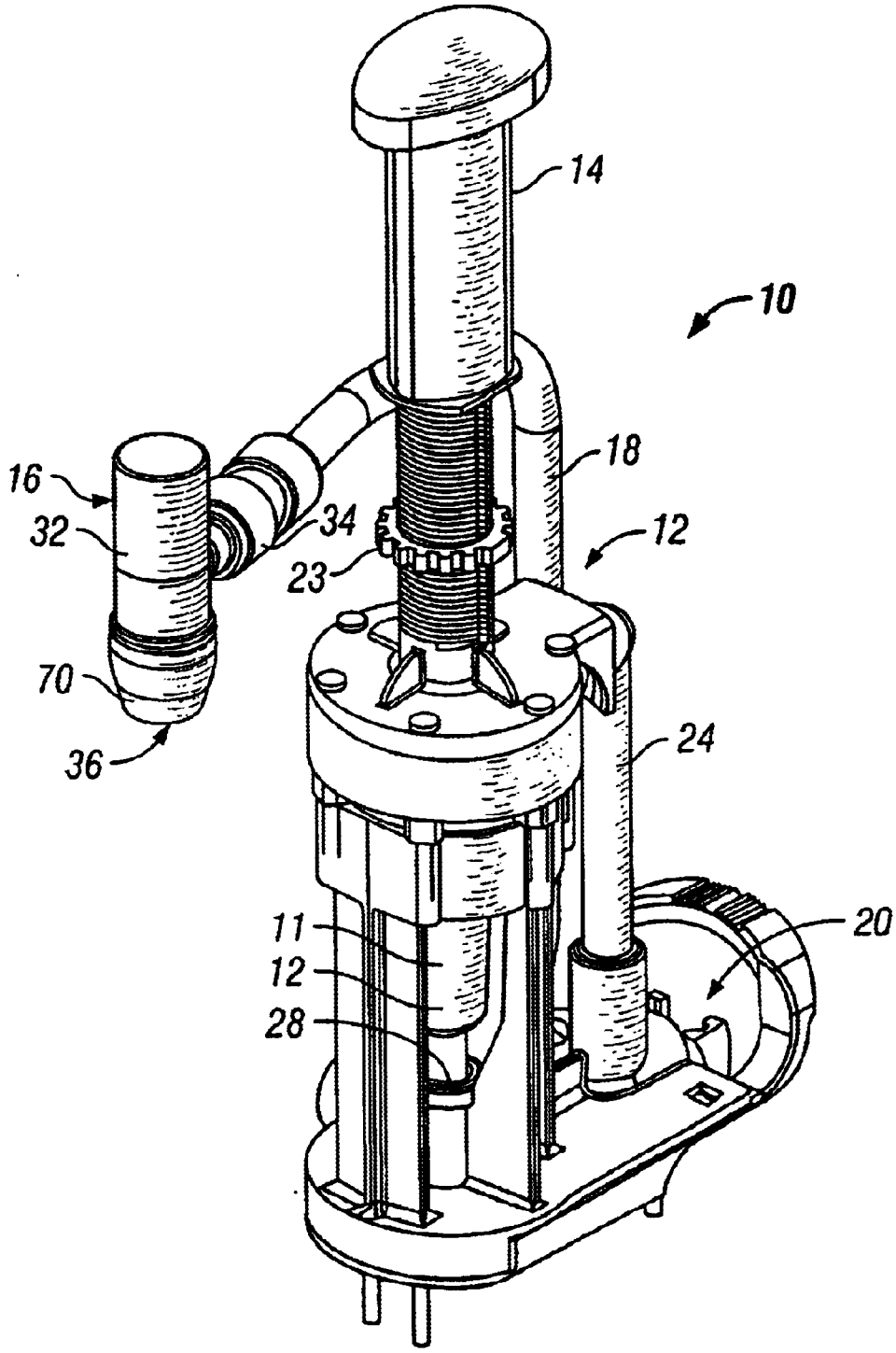
FIG. 1 is a perspective view of a comestible fluid dispensing system and tap according to a first preferred embodiment of the present invention.
Figure 2:
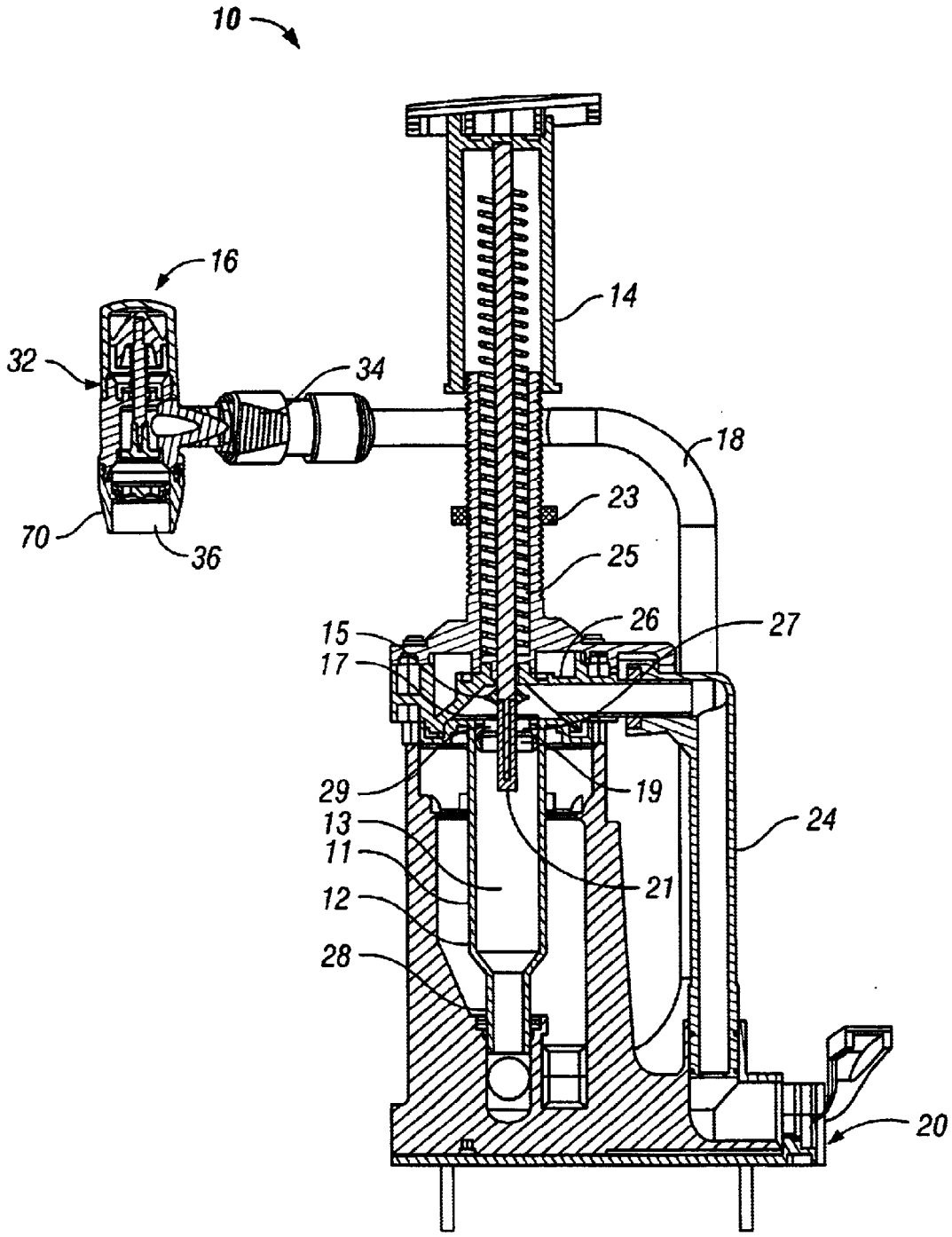
FIG. 2 is a cross-sectioned elevational view of the comestible fluid dispensing system and tap illustrated in FIG. 1, taken along lines 2—2 of FIG. 1 and showing the pump of the system in an unactuated position.
Figure 3:
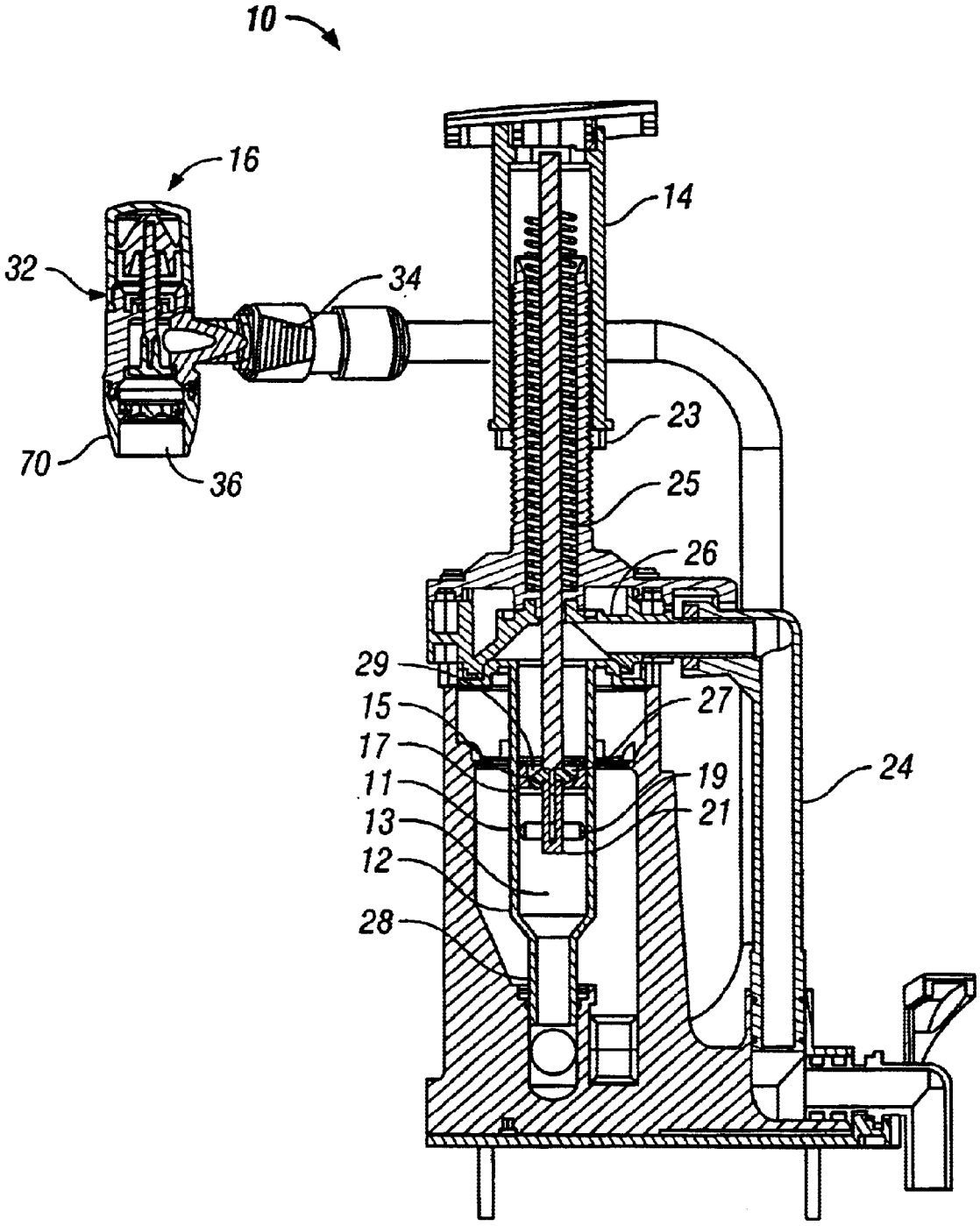
FIG. 3 is a cross-sectional elevational view of the comestible fluid dispensing system and tap illustrated in FIGS. 1 and 2, taken along lines 2—2 of FIG. 1 and showing the pump of the system in an actuated position.

A preferred embodiment of a comestible fluid dispensing system according to the present invention is illustrated in FIGS. 1–3. The dispensing system (indicated generally at 10) preferably includes a comestible fluid pump 12, a user-actuated plunger 14 connected to the pump 12, and a tap 16 connected to the pump 12 via a comestible fluid line 18. The dispensing system 10 can be connected to a source of comestible fluid via a conventional quick disconnect fluid connector 20, but can instead be connected to such a source in any other manner, including without limitation by a conventional threaded joint or fluid coupling or by a press or interference fit with a comestible fluid line running to the source of comestible fluid. A comestible fluid line 24 preferably connects an inlet 26 of the pump 12 with the fluid connector 20, and can be or include an inflexible or flexible comestible fluid conduit such as a pipe, hose, tube, and the like.

The comestible fluid pump 12 is preferably a manually-operated pump, and in one highly preferred embodiment is similar in structure and operation to the pump disclosed in U.S. Pat. No. 5,992,695 issued to Start (modified to be actuated by a plunger 14 rather than by gas pressure). However, one having ordinary skill in the art will appreciate that any conventional manually-operable pump can be employed to draw comestible fluid from the comestible fluid source and to pump the comestible fluid to the tap 16. The manually operated plunger 14 is preferably biased in an upward direction in any conventional manner, such as by one or more springs, by an actuator or motor, by comestible fluid pressure in the pump, and the like. Preferably, the plunger 14 can be pushed by a user to operate the valve in a conventional manner. Plunger-actuated valves and their manner of operation are well-known in the art and are not therefore described further herein.

The pump 12 has a comestible fluid outlet 28 which is connected to the tap 16 by the comestible fluid line 18. The comestible fluid line 18 can take any of the forms described above with reference to the comestible fluid line 24 connecting the fluid connector 20 to the pump 12. In the illustrated preferred embodiment, the comestible fluid line 24 is a substantially rigid pipe or series of connected pipes extending from the pump 12 to the tap 16.

Preferably, the pump 12 has a housing (not shown) which encloses or substantially encloses the pump 12 and comestible fluid lines 18, 24. The housing can take any shape and can be made from any material desired. Most preferably, the housing is made from a resilient material such as steel, aluminum, or other metal, plastic, composites, and the like.

The dispensing system 10 described above and illustrated in FIGS. 1–3 is a manually-operated dispensing system. However, it should be noted that the pump 12 can be automatically operated in any number of well-known manners, such as by being driven by pressurized gas as described in U.S. Pat. No. 5,992,695 mentioned above, by a hydraulic or pneumatic actuator, by a motor, and the like. In these embodiments, the pump 12 is preferably activated by one or more conventional user-manipulatable controls connected to the pump 12. Devices for automatically driving a pump and the manner in which these devices can be controlled are well-known to those skilled in the art and are not therefore described further herein.

The dispensing system 10 is preferably a non-pressurized system, but can be supplied with comestible fluid under pressure if desired. In this regard, the pump 12 can be removed in some embodiments. If desired, the pump 12 in some pressurized embodiments of the dispensing system 10 can be replaced with a valve that is controlled in a conventional manner to open and close for controlling the supply of pressurized comestible fluid to the tap 16. The dispensing system 10 can be a portioning system (in which case the amount of each dispense can, in some embodiments, be controlled as described in greater detail below) or a non-portioning system (such as a pressurized system in which one or more valves control flow of the pressurized condiment).

In some embodiments, each full actuation of the pump 12 (e.g., via the plunger 14 as described above) preferably dispenses a known desired amount of comestible fluid from the tap 16. This amount can be adjusted in a number of conventional manners, such as by adjusting the stroke of the plunger 14 in the illustrated preferred embodiment. However, the dispensing system 10 need not necessarily be a portioning system and need not necessarily be adapted to dispense a specific and controlled amount of comestible fluid in each dispensing operation.

FIGS. 4–8 illustrate the tap 16 of the present invention in greater detail. The tap 16 preferably has a body 32 through which comestible fluid flows from a tap inlet 34 to a tap outlet 36. The body 32 can be made of a single element manufactured in any manner desired, such as by being machined, injection molded, extruded, pressed, cast, and the like. Alternatively, the body 32 can be made of multiple elements permanently connected in any conventional manner to form an integral body. More preferably however, the body 32 is assembled from multiple elements to form an integral body. Specifically, the body 32 preferably has a valve portion 38, a nozzle portion 40, and a damper portion 42 releasably connected together in any conventional manner as a single integral body. These connections can be threaded connections 44, 46 as shown in FIGS. 4–8 or can be a compression, bayonet, or other preferably fluid-tight releasable connection as is well known in the art.

The tap 16 preferably has a valve 48 therein which is movable between opened and closed positions. The valve 48 preferably has at least one open position (shown in FIG. 6) and at least one closed position (shown in FIG. 8). In this regard, it should be noted that a "closed position" does not necessarily mean that there is no fluid communication through the valve 48, that the valve 48 fully seals comestible fluid upstream of the valve 48 from comestible fluid downstream of the valve 48, or that comestible fluid cannot pass the valve 48 while the valve 48 is passing through a range of closed positions. Instead, a closed position means that the valve 48 blocks or impedes comestible fluid in the valve 48 sufficiently to stop comestible fluid flow through the valve 48 and out of the tap outlet 36. It will be appreciated that for some relatively thick comestible fluids, the valve 48 does not need to fully seal upstream comestible fluid from downstream comestible fluid, but only to block or impede comestible fluid enough to stop comestible fluid flow through the valve 48 and out of the tap outlet 36. Thinner and less viscous comestible fluids may instead require a hermetic or fluid-tight seal of the valve 48 to prevent flow movement past the valve 48 and out of the tap outlet 36. The terms "opened position" and "open position" refer to valve positions in which comestible fluid is capable of flowing through the valve 48.

The valve 48 is a draw-back valve, which is also known as a "suck-back valve". Accordingly, closure of the valve 48 generates sufficient suction force upon comestible fluid downstream of the valve 48 to draw comestible fluid in a general direction toward the valve 48. In other words, closure of the valve 48 causes reversal of comestible fluid flow (in a generally opposite direction to the flow of comestible fluid during dispense).

With reference to the illustrated preferred embodiment, the valve 48 is preferably a plunger valve that is axially movable between its open and closed positions. The valve 48 is movable from an open position through a range of closed positions. During valve closure, the movement of this type of draw-back valve 48 through the range of closed positions generates the above-described suction force downstream of the valve 48.

Preferably, the valve 48 is movable through a comestible fluid passage 50 in the tap 16. The comestible fluid passage 50 is preferably defined by internal walls of the tap body 32 as shown in the figures. These internal walls can be formed by machining, injection molding, casting, or in any other conventional manner.

In other embodiments, the passage 50 can be defined by a tubular element received within the tap body and secured therein in any conventional manner, such as by one or more clips, screws, or other conventional fasteners, by adhesive or cohesive material, by being snugly received within the internal walls of the body 32, by being snap-fit in the body 32 with one or more detents, ribs, bumps, ramps, or recesses on the tubular element and/or on an inside wall of the body 32, and the like.

A comestible fluid passage defined by internal walls of the body is highly preferred for purposes of fewer tap components and reduced assembly time. A comestible fluid passage defined by a separate tubular element can instead be employed to permit a user or assembler to install tubular elements having different passage shapes and sizes suitable for different comestible fluids, valve shapes and sizes, and desired comestible fluid flow characteristics. Alternatively, the separate tubular element can be permanently secured within the body.

Figure 4:
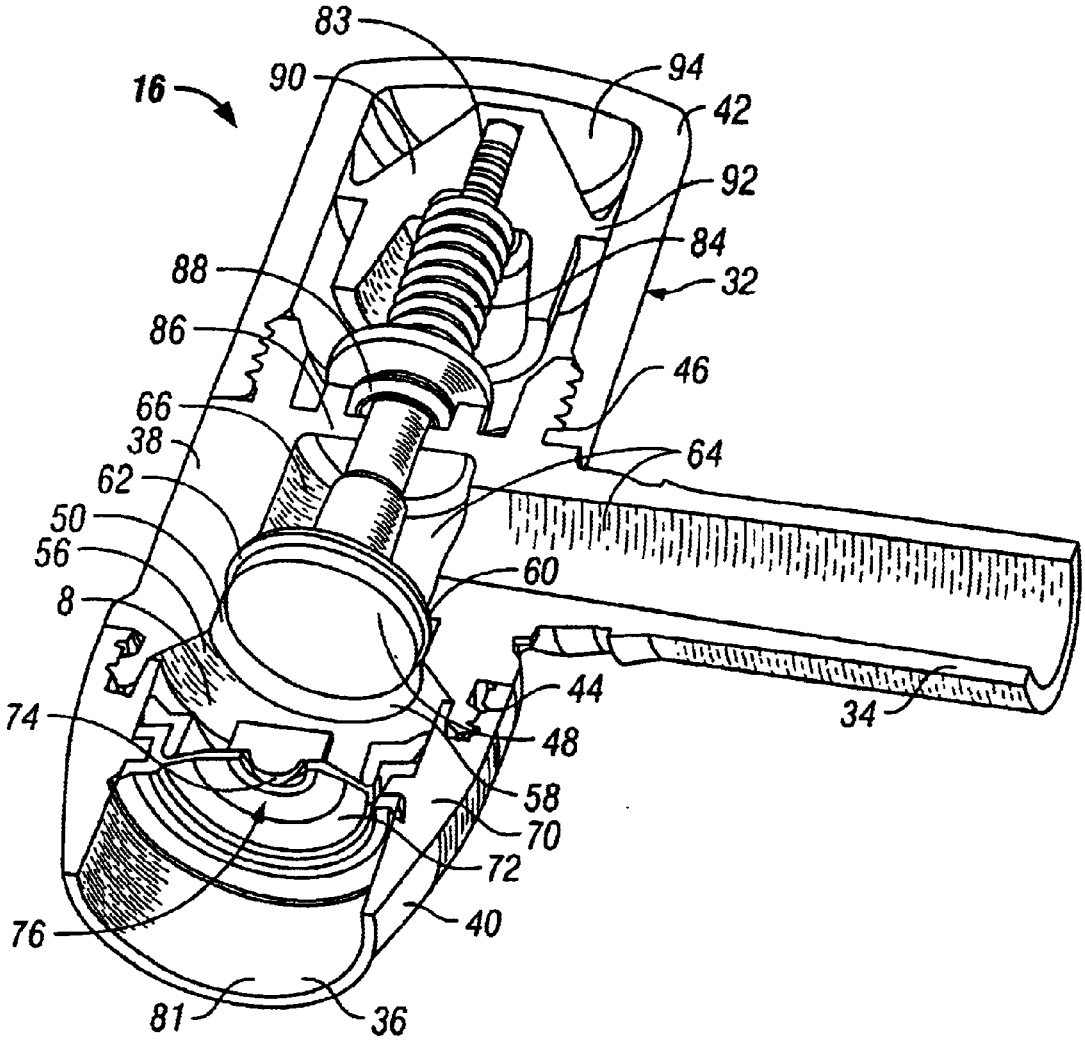
FIG. 4 is a partially cross-sectioned perspective view of the comestible fluid dispensing tap illustrated in FIGS. 1 and 2.
Figure 5:
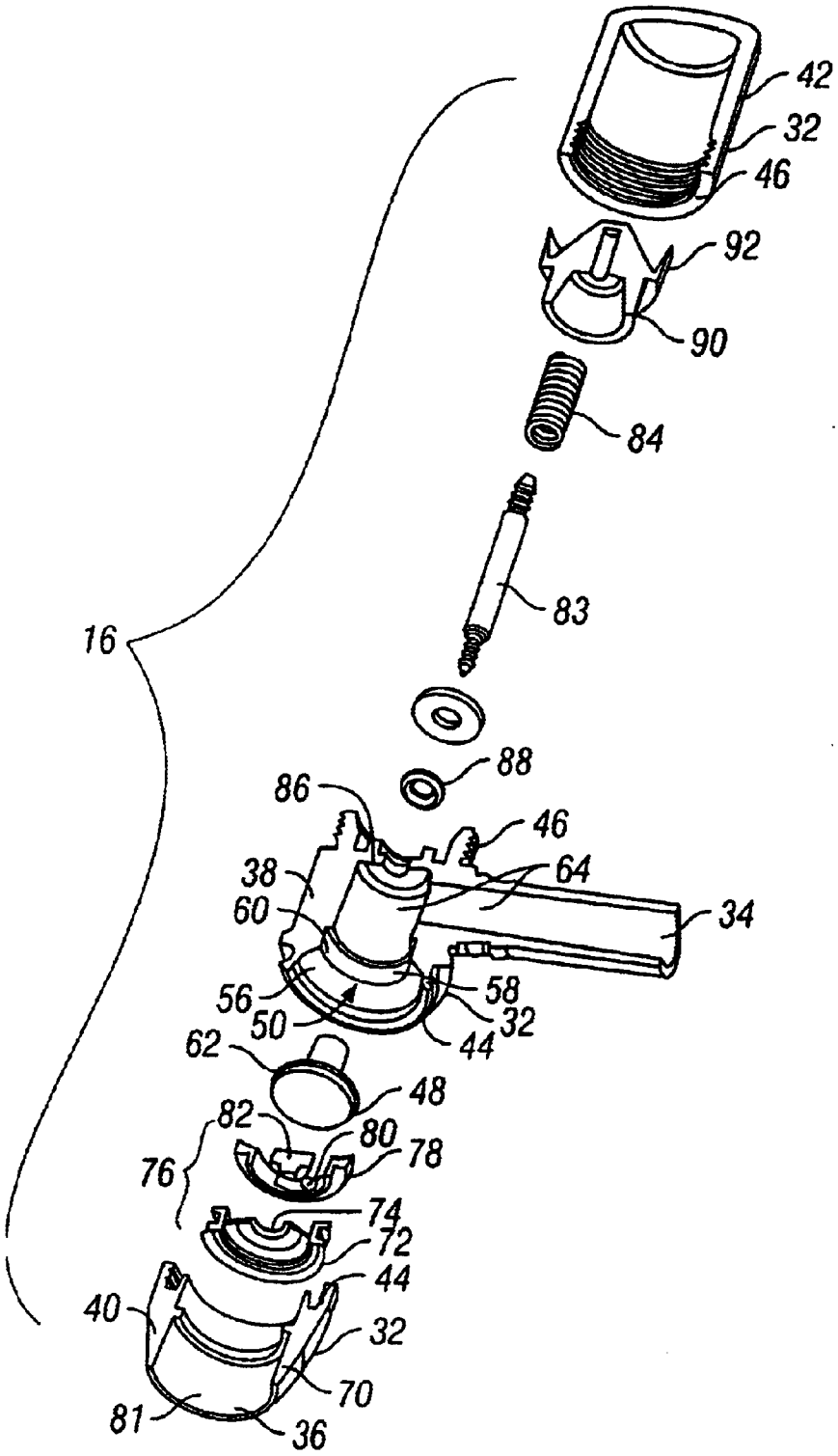
FIG. 5 is an exploded view of the comestible fluid dispensing tap illustrated in FIG. 4.
Figure 6:
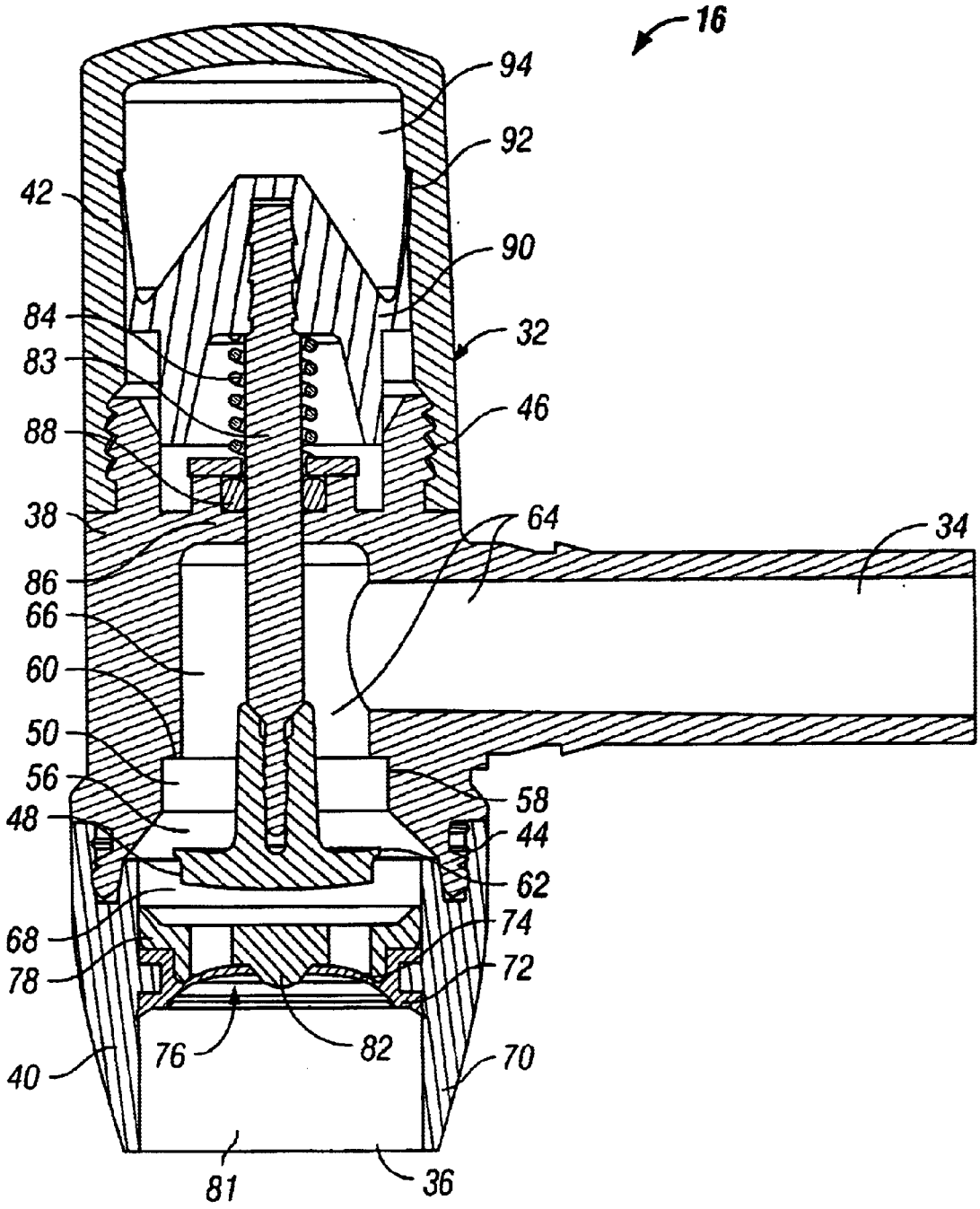
FIG. 6 is a cross-sectioned elevational view of the comestible fluid dispensing tap illustrated in FIGS. 1–5, shown with the valve in an open position.
Figure 7:
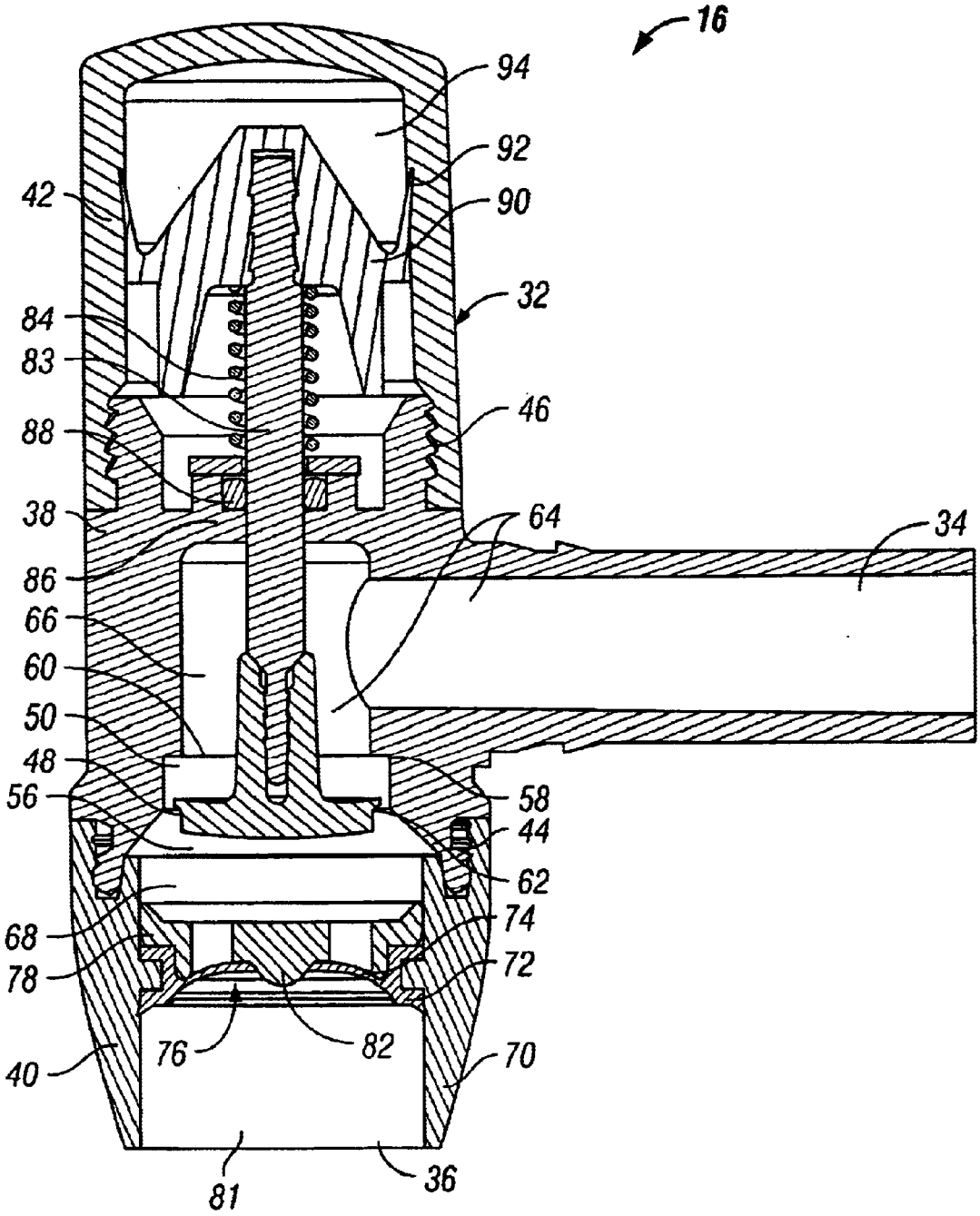
FIG. 7 is a cross-sectioned elevational view of the comestible fluid dispensing tap illustrated in FIGS. 1–5, shown with the valve in the process of closing.
Figure 8:
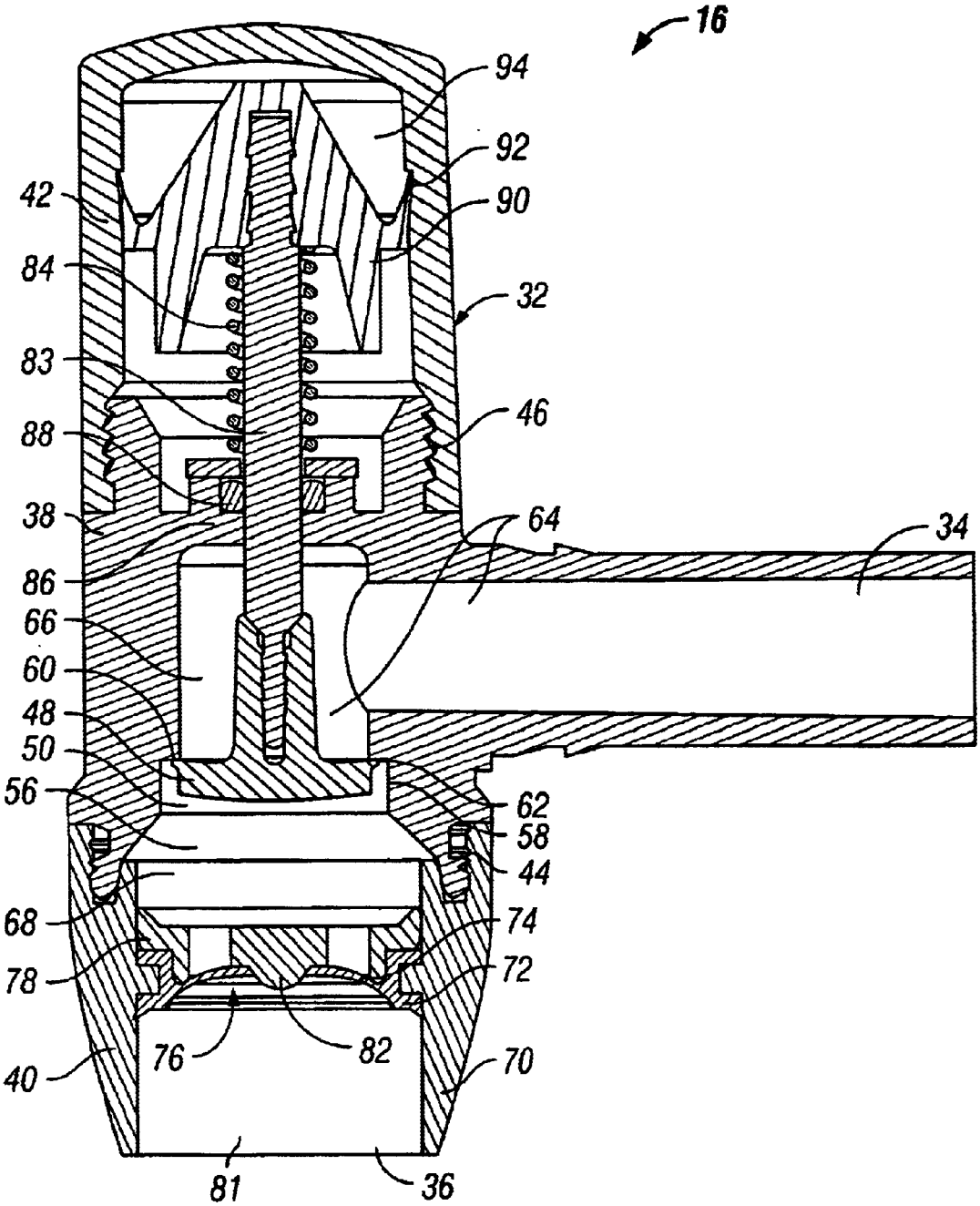
FIG. 8 is a cross-sectioned elevational view of the comestible fluid dispensing tap illustrated in FIGS. 1–4, shown with the valve in a closed position.

The comestible fluid passage 50 preferably has a round cross-sectional shape as shown in FIGS. 4–8. In this embodiment, the passage 50 has a generally funnel-shaped downstream portion 56 and a throat 58 having a substantially constant cross-sectional area. The downstream portion 56 preferably has an increasing cross-sectional area in the downstream direction. As best shown in FIGS. 6–8, when valve 48 closes, the valve 48 preferably moves from a position in the downstream portion 56 and through at least part of the throat 58 to a seat 60 preferably defined in the tap body 32.

Due to the shape of the downstream portion 56, some suction can be generated as the valve 48 moves through the downstream portion 56. Preferably however, the majority of the suction force is generated as the valve 48 moves through the throat 58 of the passage 50.

Preferably, the valve 48 is sized to provide a sliding seal against the internal walls of the throat 58, thereby enhancing suction force as the valve 48 moves through the throat during closure. The valve 48 can also have a peripheral lip or a peripheral edge 62 having a reduced thickness in order to provide this sliding seal. This lip or edge 62 can be formed upon the peripheral of the valve 48 in any conventional manner, such as by being molded with the valve 48, being machined, extruded, and the like. Alternatively, the lip or edge 62 can be a separate element such as an O-ring, flange, or other element connected to the valve in any conventional manner, such as by snap-fitting within a peripheral groove in the valve 48, being attached to the valve 48 by one or more conventional fasteners, being glued thereon, etc.

Whether integral with the valve 48 or attached thereto, the lip or edge 62 is preferably reduced in thickness with respect to the rest of the valve, and can have a knife-edge, blunted, wedge-shaped, faceted, or any other shape desired. The lip or edge 62 can be sized to provide an exact fit with the throat 58, a slight clearance with the throat 58 as shown in the figures, or can be slightly oversized with respect to the throat 58 for a relatively tight sliding seal.

Although the lip or edge 62 can be made of a number of different resilient materials such as steel, aluminum, or other metals, composites, or ceramic, it is preferably made of a resiliently deformable material such as plastic, rubber, nylon, urethane, and the like to provide a better seal with the throat 58. The valve 48 in the illustrated preferred embodiment is made of plastic and has a resiliently deformable lip 62 integral therewith as best shown in FIGS. 6–8.

The shape and size of the passage 50 significantly impacts the draw-back feature of the valve 48. In some highly preferred embodiments such as that shown in the figures, the valve 48 moves through a portion of the passage 50 having a constant or substantially constant cross sectional area to generate a significant downstream suction force during valve closure. However, suction force can also or instead be generated in passages having increasing or decreasing cross-sectional areas. One having ordinary skill in the art will appreciate that suction is likely to be more difficult to produce in a passage or passage portion having a decreasing cross sectional area in the downstream direction (i.e., the opposite shape of the downstream portion 56 in FIGS. 4–8). However, such suction is possible depending at least partially upon valve shapes and the relative sizes of the valves and passages employed.

More preferably, the valve 48 is movable through a passage or passage portion having a constant cross-sectional area or an increasing cross-sectional area in the downstream direction. Some preferred embodiments of the present invention employ passages 50 having only a constant cross sectional area or only an increasing cross-sectional area in the downstream direction. Other more preferred embodiments employ passages 50 having passage portions of each shape. The tap 16 illustrated in FIGS. 4–8 is one example of such a passage 50. Although in this embodiment the constant cross-sectional area passage portion 58 is located upstream of the passage portion 56 having an increasing cross-sectional area in the downstream direction, these portions can be reversed in other embodiments. In addition, although only one of each type of passage portion is shown in FIGS. 4–8, other embodiments of the present invention can have two or more passage portions of each type positioned with respect to one another in any desired manner.

As described above, some highly preferred embodiments of the present invention employ passages 50 that are either constant in cross sectional area or increase in cross-sectional area, or employ passages 50 having one or more portions of each type. It should be noted that passages or passage portions having changing cross-sectional areas can be shaped in a number of different manners. For example, these passages 50 or passage portions can have relatively flat walls, curved walls (either convex or concave) or irregularly-shaped walls with any degree of wall convergence or divergence desired. The majority of the walls of downstream portion 56 in FIGS. 6–8 are relatively flat and shallow (converge relatively quickly to the throat portion 58). However, the walls of the downstream passage portion 56 could instead be steeper and/or could be bowed toward passing comestible fluid or away from passing comestible fluid. Furthermore, the walls of downstream passage portion 56 in FIGS. 6–8 could be faceted, with different portions having different steepnesses to define a somewhat bowl-shaped exit of the passage 50. The illustrated wall shapes are preferred for superior comestible fluid flow control. However, other wall shapes can be used, such as flat or curved smooth walls, stepped converging or diverging walls, and the like.

The comestible fluid passage 50 is preferably round in shape and matches a round valve 48. However, the passage 50 and valve 48 can instead take any cross-sectional shape desired, including without limitation oval, elliptical, rotund, square, rectangular, polygonal, or irregularly-shaped passages 50 preferably matching similarly-shaped valves 48. Other than increasing in diameter, the cross-sectional shape of the passage 50 in the illustrated preferred embodiment is the same along its length. In some embodiments however, the cross-sectional shape of the passage 50 changes along its length.

The shape of the passage 50 and valve 48 in the present invention is important to the draw-back force generated in closure of the valve 48, and therefore to the amount of comestible fluid that can be drawn back by valve closure. The inventors have found that a throat 58 having a constant or relatively constant cross-sectional area followed downstream by diverging walls in a downstream passage portion 56 provides superior and repeatable draw-back force in which a smooth transition between no suction and full suction can be produced. By changing the shape (e.g., the degree of wall convergence, the profile shape of the walls, etc.) of those portions of the comestible fluid passage 50 in which the valve 48 moves, the draw-back force of the valve 48 can be changed. This control is valuable particularly in light of the significantly different types of comestible fluid that can be delivered through the tap 16, each needing different draw-back forces based at least in part upon comestible fluid viscosity.

The size of the passage 50 is also important to the draw-back force generated in closure of the valve 48, and therefore to the amount of comestible fluid that can be drawn back by valve closure. A passage 50 having a larger volume (i.e., longer or having a greater diameter) is normally capable of producing greater draw-back than one having a smaller volume. In addition, the size of the fluid line 64 downstream of the valve 48 is also important to the ability of the valve 48 to draw back condiment. A smaller-volume fluid line downstream of the valve 48 is normally capable of producing greater draw-back than one having a larger volume. Preferably, the passage diameter and length and the size of the fluid line 64 downstream of the valve 48 are selected according to the type of condiment to be dispensed and the amount of draw-back desired. Passages 50 defined by a separate tubular element as described above provide a manner in which a user or assembler can adapt the tap 16 to produce different draw-back forces by replacing one tubular element with another tubular element having different internal dimensions.

In some preferred embodiments of the present invention, the comestible fluid passage 50 includes an upstream portion (upstream of the range of valve movement) having converging walls in the downstream direction. Such an upstream shape can enable improved flow of comestible fluid to the valve 48. In other embodiments such as the illustrated preferred embodiment, the upstream passage portion has a relatively constant cross sectional area. Like the downstream passage portion 56 described above, the upstream passage portion can have converging, diverging, or relatively straight walls having any shape desired.

As described above, another factor controlling draw-back force of the valve 48 is the manner in which the valve 48 relates to the comestible fluid passage 50. Relatively high draw-back forces are generated by valves 48 that are closely fit to a comestible fluid passage 50 or comestible fluid passage portion having a constant cross sectional area, thereby establishing a sliding seal as described above. A slight clearance between the comestible fluid passage 50 and the valve 48 (whether in a passage section having a constant cross-sectional area or by virtue of converging or diverging passage walls) can permit comestible fluid movement around the valve during closure. In such cases, the draw-back force can be lower to any desired degree.

Proper operation of the valve can be dependent upon the type of comestible fluid being dispensed. Therefore, in some embodiments of the present invention used for dispensing relatively thick comestible fluids, a significant clearance between the valve 48 and passage 50 can exist while still preventing comestible fluid flow when the valve 48 is closed and while still generating a desired suction force upon valve closure. In other embodiments used for dispensing thinner comestible fluids, less or no clearance between the valve 48 and passage 50 is needed to stop comestible fluid flow when the valve 48 is closed and to generate a desired suction force upon valve closure. To control the drawback force upon a comestible fluid or to adapt a tap 16 for a particular comestible fluid type, different interchangeable valve sizes can be provided for use with the same passage 48 and can be changed by the manufacturer or user.

The comestible fluid passage 50 preferably has a valve seat 60 as described above. This seat provides a closed position of the valve 48, and is preferably one of a range of closed positions as also described above. However, a valve seat 60 is not required in some embodiments of the present invention, such as in those cases where the range of travel of the valve 48 is limited in some other conventional manner (e.g., by the range of travel of the valve actuator, by stops on a valve rod, and the like) or where a tight seal is not needed to prevent comestible fluid flow past the valve 48 and out of the tap outlet 36 when the valve 48 is closed (such as for relatively thick comestible fluids).

The amount of draw-back provided by the tap 16 can also be a function of the range of movement of the valve 48. In embodiments employing a plunger valve 48 for example, the amount of axial movement is normally related to the amount of draw-back force generated during valve closure. With continued reference to FIGS. 6–8, the valve 48 preferably moves through part of the downstream passage portion 56 and through the throat portion 58. In other embodiments, the valve 48 can move fully through the downstream and throat portions 56, 58 of the passage 50, can move only in the throat portion (in which case axial fluid passages or grooves at the downstream end of the throat 58 can permit comestible fluid flow toward the tap outlet 36), can move only in part of the throat 58 and in all, part, or none of the downstream portion 56, and the like. If desired, the valve 48 can be controlled to move through any portion of the passage 50 to generate a controlled amount of draw-back force depending at least in part upon the type of comestible fluid used and the amount of comestible fluid draw-back needed. For example, the valve 48 can move through a full range of travel for drawing back one type of comestible fluid while being controlled to move only through a downstream portion of its range of travel for drawing back another type of comestible fluid. Some highly preferred embodiments of the present invention permit valve movement control over two or more ranges in the passage 50, which ranges can include any part or none of different passage portions defining the passage 50.

Some valves are capable of generating a draw-back force during closure even though they do not have a range of closed positions as defined above (i.e., they permit comestible fluid flow past the valve 48 and through the tap outlet 36 in substantially every position but one closed position). Such valves can be used in connection with the tap 16 of the present invention, although valves having a range of closed positions are preferred.

Although the plunger valve described herein is preferred, other valve types can instead be used to produce sufficient draw-back force to pull comestible fluid back into the tap upon valve closure. By way of example only, a swing or lift-type valve can be used in which a gate member of the valve can swing or be drawn through the comestible fluid to a closed position, thereby generating the desired suction downstream of the gate member. As another example, a pinch valve can be used in which the pinch point of the valve moves some distance in the upstream direction after closure (e.g. by eccentric rotating pinch members on either side of a flexible passage or in any other conventional manner). One having ordinary skill in the art will appreciate that still other types of draw-back valves and draw-back valve structures can be used in place of a plunger valve, each one of which falls within the spirit and scope of the present invention. Such other valve types can also be used in conjunction with a comestible fluid passage 50 as described above (modified as needed to facilitate valve movement as needed).

It should be noted that in the various embodiments of the present invention, the draw-back force exerted by the valve 48 used need not necessarily be generated by a vacuum force from retraction or other movement of the valve 48. Although such a vacuum can be effective for the purpose of drawing back downstream comestible fluid as described above, it is not required for operation of the present invention. Surface tension of the comestible fluid upon a surface of the valve (or upon a surface of an element moving to pull fluid in an upstream direction) is also effective to perform the draw-back function.

For example, the surface of the plunger valve 48 in the illustrated preferred embodiment is preferably in contact with comestible fluid downstream of the valve 48. Retraction of the valve 48 therefore preferably pulls this comestible fluid upstream, drawn under surface tension of the fluid in contact with the valve 48. In other embodiments, different elements that are retractable and are in contact with the comestible fluid downstream of the valve 48 can draw back the comestible fluid in a similar manner. These different elements need not necessarily be capable of closing or opening the fluid line 64 in the tap 16, but are at least capable of providing surface area upon which the downstream comestible fluid can hold.

By way of example only, a plate connected to the valve 48 and in contact with comestible fluid downstream of the valve 48 can be in sufficient contact with the downstream comestible fluid to draw back the downstream comestible fluid. As another example, a smooth, ribbed, finned, apertured, or dimpled rod, pin, ring, or other element extending from the valve 48 into the downstream fluid can provide sufficient surface area onto which the comestible fluid can hold in a draw-back operation. One having ordinary skill in the art will appreciate that any element (preferably providing as much surface area as possible for the downstream comestible fluid to contact) used in conjunction with any valve type can be employed to generate a draw-back force as described above. As used herein and in the appended claims, the term "suction" and reference to a draw-back force from valve closure refers to force generated as a result of vacuum and/or surface tension acting upon the comestible fluid being drawn back.

The valve 48 and passage 50 of the present invention can be located anywhere within the tap 16 (from the tap inlet 34 to the tap outlet 36) and is preferably located near the tap outlet 36 as illustrated for excellent control over draw-back force and comestible fluid flow between the valve 48 and the tap outlet 36. The draw-back valve is most preferably an integral part of the tap 16, although the draw-back valve can be connected to the remainder of the tap 16 as a tap component. A draw-back valve 48 located within the tap 16 facilitates easy draw-back valve incorporation into existing dispensing systems. By connecting the tap 16, the user connects the draw-back valve 48 and need not make additional comestible fluid or fluid flow controls connections to the tap 16 or upstream dispensing systems components in order to obtain draw-back capability. This increases assembly speed and lowers assembly cost.

Regardless of valve location in the tap, the valve 48 is part of the tap 16 and is located along the comestible fluid line 64 in the tap 16. The comestible fluid line 64 in the tap 16 is defined by the walls of the tap 16 through which comestible fluid passes from the tap inlet 34 to the tap outlet 36. In contrast to conventional dispensing systems having drawback capability, the valve 48 in the tap 16 performs the dual functions of opening and closing the tap 16 and drawing comestible fluid back into the tap 16 upon valve closure.

The comestible fluid line 64 running through the tap 16 can take any shape and can be any size desired, depending upon such factors as comestible fluid type, flow rate, etc. The comestible fluid line 64 in the tap 16 of the illustrated preferred embodiment has internal chambers 66, 68 upstream and downstream of the valve 48, although it should be noted that either or both of these chambers 66, 68 can be eliminated in other embodiments. These chambers are generally axially aligned with the valve 48, but can be relatively positioned in any other manner. Also, the upstream internal chamber 66 is preferably located in the valve portion 38 of the tap body 32 while the downstream internal chamber 66 is preferably located in the nozzle portion 40 of the tap body 32. However, the locations of these chambers 66, 68 in the tap body 32 or in relation to tap body portions 38, 40, 42 can be different in other embodiments.

It may be desirable to provide some manner in which to enclose most or all comestible fluid located downstream of the valve 48. In those embodiments where the valve 48 and passage 50 are at the end of the tap 16 (i.e., define the tap outlet 36), this is less of a concern. However, a more recessed location for the valve 48 is often preferred in order to provide better flow control downstream of the valve 48 and to prevent or reduce comestible fluid spitting. Taps with such structure therefore have a nozzle 70 through which comestible fluid passes from the valve 48 on its way to the tap outlet 36 (defined by the end of the nozzle 70).

Some preferred embodiments of the present invention having a nozzle 70 also employ a shield 72 located in the comestible fluid line 64 downstream of the valve 48. Whether used alone (with or without the plunger valve 48), or as part of a cutoff valve as described in more detail below, the shield 72 performs multiple functions in the tap 16. The shield 72 is a wall that helps to prevent or reduce comestible fluid spitting and at least partially encloses comestible fluid located in the nozzle 70. An aperture 74 in the shield 72 permits comestible fluid exit through the shield 72 to the tap outlet 36. The aperture 74 can be any shape or size desired depending at least in part upon the characteristics of the comestible fluid being dispensed. As an alternative to the single aperture 74 in the center of the shield 72 as illustrated, the shield 72 can instead have one or more apertures located in any position on the shield 72. The aperture(s) 74 can instead or also be defined between the shield 72 and the interior walls of the tap body 32.

The shield 72 can be connected to the tap body 32 in any conventional manner, such as by any of the manners described above with reference to connection of the comestible fluid passage 50 within the tap body 32. As best shown in FIGS. 4–8, the shield 72 is preferably retained in the body 32 by a tongue and groove connection between the peripheral edge of the shield 72 and the inside walls of the nozzle 70. The shield 72 is most preferably releasably connected to the nozzle 70, but can instead be permanently connected thereto or can even be integral with the walls of the nozzle 70. A removable shield permits shield replacement with other interchangeable shields having different aperture sizes for different types of comestible fluid and desired comestible fluid flow characteristics.

The shield 72 can be made of any resilient material desired, such as plastic, metal, or composites. Such shields 72 can be sufficiently strong to resist deformation, and can be secured in place within the tap 16. However, some highly preferred embodiments of the present invention have a shield 72 made partially or entirely of resiliently deformable material such as rubber, neoprene, urethane, and the like. The shield 72 is therefore capable of deforming under comestible fluid pressure in the body 32. This ability to deform provides a manner in which comestible fluid downstream of the shield 72 can be dislodged at the end of a dispense. Specifically, the shield 72 preferably snaps back to its undeformed state when the upstream pressure is reduced sufficiently (by closure of the valve 48 or by reduction of pressure upstream of the valve 48). This motion preferably acts to dislodge comestible fluid that may be hanging from the shield 72, the aperture 74 therein, or from the walls of the nozzle 70 downstream of the shield 72.

Another advantage of employing a resiliently deformable shield 72 is the ability to change the size of the aperture 74 therein upon dispense of comestible fluid. While in some embodiments the aperture 74 need not significantly change shape or size when the shield deforms (e.g., such as where the shield thickness is larger adjacent to the aperture or is otherwise reinforced in this area), the aperture 74 in other preferred embodiments changes size when the shield deforms. Most preferably, the aperture 74 increases in diameter by the deformation of the shield 72. An advantage of this feature is that the aperture 74 is smallest when the shield 72 is undeformed and is largest when the shield 72 is deformed. Therefore, condiment is better retained upstream of the shield 72 between condiment dispenses and can pass through the aperture 74 more easily during dispense when the shield 72 is deformed. This feature therefore helps to prevent clogging by enabling the passage of obstructing particles in the condiment.

Yet another advantage of employing a resiliently deformable shield 72 is the ability of the shield 72 to absorb rapid expansions upstream of the shield 72, such as by escaping gasses trapped in the dispensing system 10. Although a non-deformable shield can provide protection against such expansions, a deformable shield has been found to provide superior performance.

Several different shield shapes can be employed to resiliently deform as just described. Most preferably, the shield 72 takes one form with little or no upstream comestible fluid pressure and one or more other forms in reaction to upstream comestible fluid pressure. By way of example only, the shield 72 in the illustrated preferred embodiment normally presents a convex shape toward the valve 48, but under pressure can deform to present a concave shape toward the valve 48. When pressure upstream of the shield 72 reduces sufficiently, the shield 72 preferably returns to its original shape. In some embodiments, the shield 72 is not inherently biased into one form as described above, but instead takes one form in response to upstream comestible fluid pressure when the valve 48 is open and another form in response to suction force from the valve 48 as the valve 48 closes. Even for shields 72 that are inherently biased into one form as illustrated in FIGS. 4–8, the suction force from valve closure can assist in movement of the shield 72 for dislodging comestible fluid.

In alternative embodiments of the present invention, the shield 72 is capable of movement in other manners (rather than just by deforming as described above). Specifically, the shield 72 can be connected in the nozzle 70 for movement therein. For example, the shield 72 can be received within an oversized annular groove in the inside on the nozzle 70 and can be axially movable therein in response to comestible fluid pressure changes. Although such a shield can be biased in any conventional manner (springs, magnet sets, and the like) in one position and can be pushed away from this position by upstream comestible fluid under pressure, this shield 72 can instead be unbiased for axial motion in the groove. In either case, shield motion can dislodge comestible fluid in a similar manner to that described above with respect to the deformable shield 72, and can absorb rapid expansions upstream of the shield 72. One having ordinary skill in the art will appreciate that the shield 72 can be connected for movement in the nozzle 70 in other manners, each one of which permits shield motion 72 in response to comestible fluid pressure changes, and each one of which falls within the spirit and scope of the present invention.

Another advantage of using a shield 72 is the ability to use the shield 72 to seal or substantially seal comestible fluid upstream of the shield 72 between dispenses. Although some preferred embodiments of the present invention only employ a shield 72 for the purposes discussed above, the shield 72 in some highly preferred embodiments (such as that illustrated in the figures), is part of a cutoff valve 76. The cutoff valve 76 preferably opens with sufficient upstream comestible fluid pressure and that closes with insufficient upstream comestible fluid pressure or with upstream suction. Sufficient upstream pressure is preferably present when the valve 48 is open and comestible fluid under pressure flows past the valve 48 and toward the tap outlet 36. Insufficient upstream pressure is preferably present either when the valve 48 is closed or when the valve 48 is open but the comestible fluid is not sufficiently pressurized to move through the valve 48 and toward the tap outlet 36. Upstream suction is preferably present when the draw-back valve 48 is in the process of closing as described above or when the drawback valve 48 has closed and leaves a negative pressure between the closed draw-back valve 48 and the closed cutoff valve 76.

Preferably, the cutoff valve 76 includes the shield 72 and a cutoff valve seat 78 as best shown in FIGS. 4 and 5. The cutoff valve seat 78 is preferably secured within the body 32 of the tap 16 in any conventional manner, such as those described above with reference to the connection of a separate tubular element to the tap body 32 for defining the fluid passage 50 of the valve 48. The cutoff valve seat 78 is preferably shaped to close the aperture 74 in the shield 72 while permitting comestible fluid flow to the shield 72. Preferably, the cutoff valve seat 78 is ring shaped and has an arm 80 extending to a plug portion 82 for plugging the shield aperture 74. The plug portion 82 can be any shape desired that is sufficient for plugging the aperture 74, but preferably is generally round as shown in FIGS. 4 and 5. One having ordinary skill in the art will appreciate that a number of other seat types and shapes can be employed to accomplish the functions of seat 78 just described. By way of example only, the seat can be a pin, bar, or other member connected to or otherwise extending from an interior wall of the nozzle 70 to a plug located adjacent to the shield aperture 72.

When comestible fluid pressure upstream of the cutoff valve 76 reaches a desired level upon opening of the valve 48, the shield 72 deforms or otherwise moves as described above away from the cutoff valve seat 78, thereby opening the shield aperture 72 to permit comestible fluid to exit through the shield 72. When the comestible fluid pressure drops sufficiently, such as from a drop in comestible fluid pressure to the tap 16 or due to closure of the valve 48, the shield 72 preferably returns to its original shape or otherwise moves toward the cutoff valve seat 78 to close the shield aperture 72 and to stop comestible fluid flow through the shield 72. Advantageously, this action closes comestible fluid downstream of the valve 48 from the outside environment and from drying out, thereby helping to keep the comestible fluid from spoiling while preventing comestible fluid leakage from the tap 16 between dispenses. Movement of the shield 72 also dislodges comestible fluid which may be hanging from the tap 16 downstream of the cutoff valve 72, thereby reducing the chances of unsightly comestible fluid buildup and dangling comestible fluid.

Although the cutoff valve 76 does not have to be used in conjunction with the valve 48 described above (either one alone providing advantages over conventional comestible fluid tap designs), the combined operation of the plunger valve 48 and the cutoff valve offers additional advantages. In particular, improved closure of the cutoff valve 76 is enabled by the suction generated from the closing plunger valve 48 described above. Most preferably, this suction is maintained after the plunger valve 48 has stopped moving after closure, thereby maintaining a reduced pressure within the tap 16 between the plunger and cutoff valves 48, 76. This reduced pressure can provide a better seal for comestible fluid between these valves and can reduce the chances of cutoff valve opening and dripping between dispenses, especially in those cases where the comestible fluid weight could otherwise bias the cutoff valve 76 open or in which the tap 16 is subject to vibration or other movement.

In those embodiments of the present invention where both valves 48, 76 are employed, it should be noted that the cutoff valve 76 is preferably adapted to close only after a sufficient amount of comestible fluid has been drawn upstream through the cutoff valve 76 or at least upstream toward the cutoff valve 76. This is enabled by control of the speed at which the plunger valve 48 closes and/or by selecting the biasing force of the shield 72 towards its seated shape or position. In some highly preferred embodiments, the cutoff valve 76 reacts a short time after suction is exerted therethrough by the closing plunger valve 48, thereby permitting sufficient time for comestible fluid to be drawn upstream through the cutoff valve 48 prior to cutoff valve closure. In these and other embodiments, the shield 72 of the cutoff valve 76 only moves to close under sufficient suction force from the plunger valve 48 and/or moves slower than comestible fluid flows upstream through the aperture 74 in the shield 72. These embodiments can employ a shield 72 that is normally biased away from the cutoff valve seat 78 (generally opposite of the shield 72 described above) or even an "over-center" shield 72 biased away from unstable intermediate positions to concave upstream and concave downstream stable positions similar to those shown in FIGS. 6 and 8, respectively. Such diaphragm-type elements are well known to those skilled in the art and are not therefore described further herein.

Regardless of the manner in which the cutoff valve 76 opens and closes with respect to movement of the valve 48, the cutoff valve 76 preferably has an open and a closed position as described above and preferably moves with respect to a seat in response to pressure changes of comestible fluid upstream of the cutoff valve 76 (whether induced by movement of the upstream valve 48 or otherwise).

It will be appreciated by one having ordinary skill in the art that a number of alternative cutoff valve types exist which can be used in place of the cutoff valve 76 described above. Such alternative cutoff valves are capable of performing the same functions described above with reference to the cutoff valve 48 and can open and/or close responsive to comestible fluid pressure changes. These alternative cutoff valves and their operation are well known to those skilled in the art and fall within the spirit and scope of the present invention.

Preferably, the outlet 36 of the tap 16 is defined by the end of a skirt 81 extending past the shield 72 or past the valve 48 if a shield 72 is not used. This skirt 81 helps to redirect flow to a desired direction and helps to hide unsightly comestible fluid which may remain on the tap after exiting the cutoff valve 76 or valve 48. The skirt 81 is preferably a wall defined by an extension of the tap body 32, and can be integral therewith as shown in the figures or can be a separate element connected thereto in any conventional manner.

The plunger valve 48 in the illustrated preferred embodiment is preferably connected to a biasing mechanism which urges the valve 48 into a normally-closed position. One skilled in the art will recognize that several conventional structures and elements can be used for this purpose. In the illustrated preferred embodiment for example, the valve 48 is connected to a valve rod 83 which itself is biased in a valve-closing direction by a coil spring 84 as shown in FIGS. 4–8. Other biasing elements such as leaf springs, magnet sets (electromagnetic and controlled or otherwise) located on the valve rod 83 and on adjacent body structure, one or more elastic elements connected to the valve rod 83 and to the tap body 32, and the like. In other embodiments, a gas spring can be secured within the tap body 32 and to the valve 48 to bias the valve in a closed direction. Alternatively, one or more springs or other biasing elements can be connected directly to the valve 48 and to the tap body 32 to perform this same function. Still other conventional biasing elements can instead be used if desired.

In the illustrated preferred embodiment, the valve rod 83 passes through a body wall 86 partially defining the comestible fluid line 64 described above. The portion of the valve rod 83 on the opposite side of the body wall 86 is connected to the coil spring 84 for being biased as described above. A gasket 88 can be used to prevent leakage of comestible fluid around the valve rod 83, and is preferably conventional in nature (e.g., comprising plastic, rubber, nylon, or other well-known gasket material in any desired shape, such as an O-ring or washer-shaped gasket 88).

Although not required for proper operation, the valve rod 83 is preferably connected to a damper 90 which is movable in the tap body 32 with movement of the valve 48. The damper 90 can be connected to the valve rod 83 in any conventional manner, such as by press-fitting, fastening with conventional fasteners, adhesive, a threaded connection, snap-fitting, or can even be integral with the valve rod 83. Similarly, the valve rod 83 can be connected to or can be integral with the valve 48 in any such manner. Disconnectable valve rods 83 are preferred in some embodiments to permit the tap assembler or even the end user to easily interchange one valve 48 or damper 90 with another valve 48 or damper 90, respectively. This is particularly useful for quickly adapting a tap 16 for dispensing different types of comestible fluids in which different valve sizes and damper sizes (e.g., for different frictional engagement forces as described in more detail below) are preferred.

The damper 90 preferably functions to regulate the speed at which the valve 48 moves between its open and closed positions. To this end, the damper 90 can be sized to snugly fit within the tap body 32 so that movement of the damper 90 and the connected valve 48 is capable only with sufficient force and only against friction force of the damper 90 against the inside walls of the body 32. Such a damper 90 is illustrated in FIGS. 4–8. To enable the above-described snug fit, walls 92 of the damper 90 can press against the interior walls of the tap body 32 with a degree of biasing force. One having ordinary skill in the art will appreciate that other manners of establishing frictional contact between the damper 90 and the tap body walls are possible and depend at least partially upon the shapes of the body 32 and damper 90. Each such alternative still functions to provide resistance to damper and valve movement by virtue of frictional engagement of the damper 90 against the body walls, and therefore falls within the spirit and scope of the present invention.

In addition to or instead of employing frictional engagement between the damper 90 and tap body 32 as just described, the damper 90 and internal body walls can define a chamber 94 in the tap body 32. This damper chamber 94 can be gas tight, substantially gas tight, or at least provide some resistance to movement of the damper 90. Although resistance to damper movement in a direction which enlarges the damper chamber 94 is possible, the damper 90 more preferably resists movement in a direction which reduces the size of the damper chamber 94 (thereby reducing the closing speed of the valve 48). With reference to FIG. 6 for example, if air, gas, or any mixture of gasses in the damper chamber 94 is at the pressure of the surrounding environment when the damper 90 is fully extended as shown, the damper chamber 94 resists movement of the damper 90 in an upward direction (with closing of the valve 48), and therefore can be used to regulate the speed at which the valve 48 closes. If desired, the damper chamber 94 can have a vent opening to permit controlled escape of air and/or gas from the damper chamber 94 to the surrounding tap environment or to another location. In other embodiments, the damper chamber 94 can be at a higher pressure than the surrounding environment when the damper 90 is fully retracted as shown in FIG. 8, thereby resisting movement of the damper 94 to open the valve 48 and regulating the valve opening speed.

The damper 90 can be any shape desired, subject to the functions of the damper described above. For example, a damper 90 relying only upon the above-described frictional forces to regulate valve movement need not be a wall defining a chamber in the body 32 and can instead take any shape capable of exerting a frictional biasing force against internal walls of the body 32. As another example, a damper 90 relying upon the above-described damper chamber pressures to regulate valve movement can take any shape in which the damper 90 acts as a movable wall partially defining the damper chamber 94.

In operation, comestible fluid is preferably supplied to the tap 16 by a hand pump 12, by any conventional pump powered in any other manner, by comestible fluid under pressure (e.g., in a pressurized comestible fluid system upstream of the tap 16) and supplied to the tap 16 by selectively opening an upstream valve, and the like. Preferably, and as shown in the figures, comestible fluid pressure builds in the comestible fluid line 64 upstream of the plunger valve 48 until the valve 48 is urged toward an open position. Alternatively or in addition, the valve 48 can be moved by a solenoid, motor, or other valve driving device coupled to the valve 48 in any conventional manner. Such valve driving devices are well known to those skilled in the art and are not therefore described further herein. In still other embodiments, the valve 48 can be moved by pneumatic or hydraulic pressure increase in the damper chamber 94 supplied through one or more conduits from another chamber in the pump 12 or from any other pressurized gas or fluid source. In this regard, it should be noted that the damper 90 can be replaced by one or more walls not acting as a damper as described above, but instead acting under the gas or fluid pressure to move in the tap body 32 and to move the valve 48.

As described in more detail above, the valve 48 is preferably biased by one or more springs or other biasing elements toward a closed position against which the comestible fluid acts to open the valve 48. The valve 48 moves through the passage 50 to an open position in which comestible fluid passes the valve 48 and approaches the cutoff valve 76. The cutoff valve 76 preferably opens by pressure generated by the plunger valve 48 as it opens, by increased pressure from comestible fluid flowing past the plunger valve 48, or by both of these events. Preferably, the apertured shield 72 deforms or moves under the increased pressure to unseat from the valve seat 78 and to thereby permit comestible fluid to exit through the aperture 74 in the shield 72 and out of the dispenser outlet 36 (most preferably defined by a skirt 81 at the end of the nozzle 70).

After a desired amount of comestible fluid has been dispensed from the tap 16, comestible fluid pressure preferably drops in the comestible fluid line 64. Eventually, this comestible fluid pressure drops below the pressure needed to keep the valve 48 open against the above-described valve biasing force. At this time, the valve 48 begins to close. Specifically, the valve 48 moves through the passage 50, and preferably moves through a range of closed positions as described in detail above. This movement preferably generates sufficient suction force downstream of the valve 48 to draw downstream comestible fluid in an upward direction, and preferably is sufficient to draw comestible fluid dangling from the nozzle 70 back into the nozzle 70.

In those tap embodiments employing an apertured shield 72, the suction is most preferably sufficient to draw comestible fluid past the apertured shield 72 back up through the aperture 74 therein, but is preferably at least sufficient to draw comestible fluid dangling from the nozzle 70 back into the nozzle 70. In those tap embodiments employing the apertured shield 72 as part of a cutoff valve 76, the suction is most preferably sufficient to draw comestible fluid in an upstream direction through the cutoff valve 76, but is preferably at least sufficient to draw comestible fluid dangling from the nozzle 70 back into the nozzle 70. The cutoff valve 76 is preferably returned to its original pre-dispense state and position by the suction from the closing valve 48, although the cutoff valve 76 can also or instead be returned to this state and position by one or more springs or by being shaped to be inherently biased thereto.

The suction from the closing valve 48 can be generated by passing through a passage portion having a constant cross-sectional area. However, this suction can also be generated without such an area (e.g., by moving the valve 48 through a passage portion not defining a closed range of the valve 48 but still generating sufficient suction as described immediately above).

Figure 9:
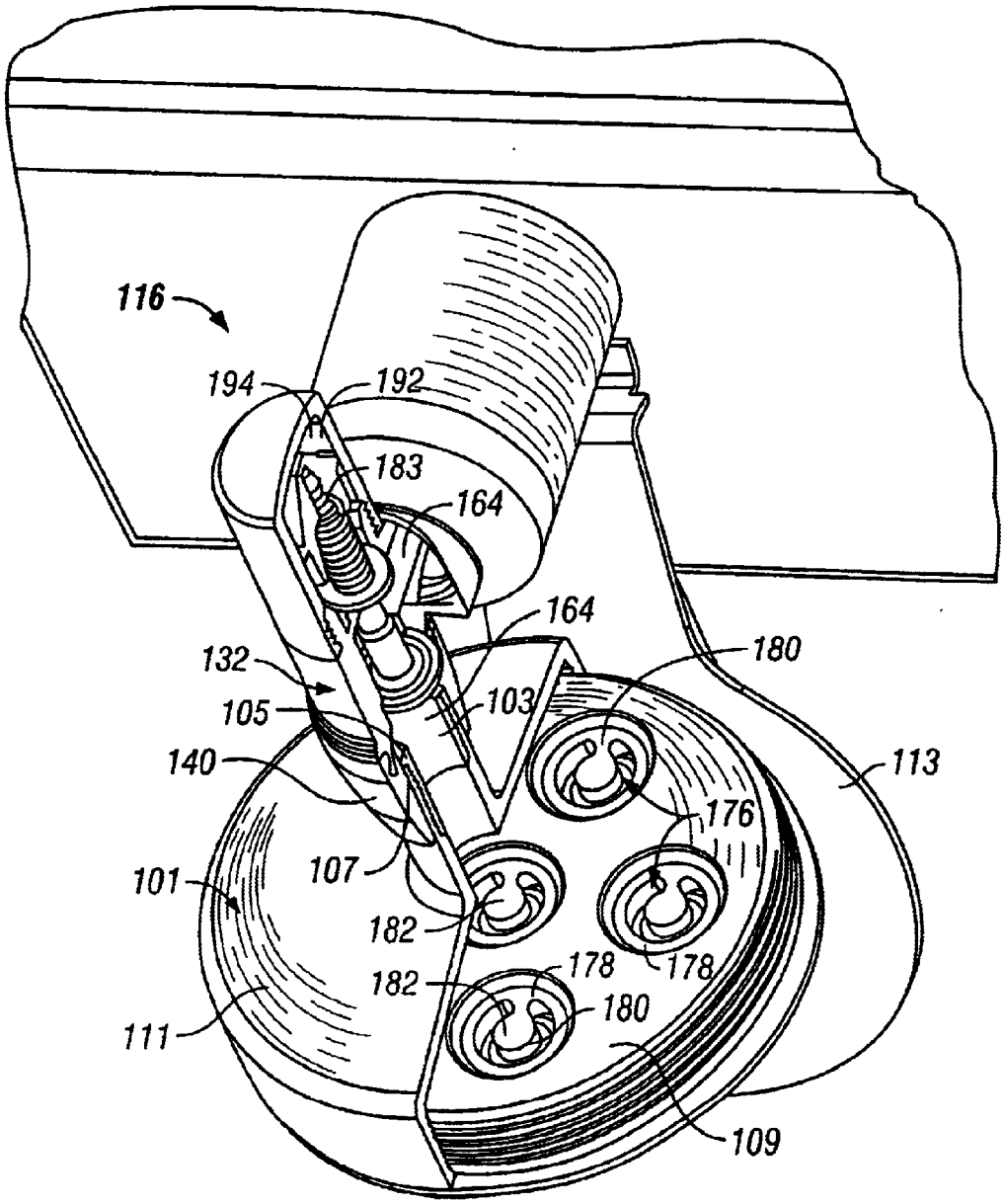
FIG. 9 is a partially cross-sectioned top perspective view of a comestible fluid dispensing tap according to a second preferred embodiment of the present invention.
Figure 10:
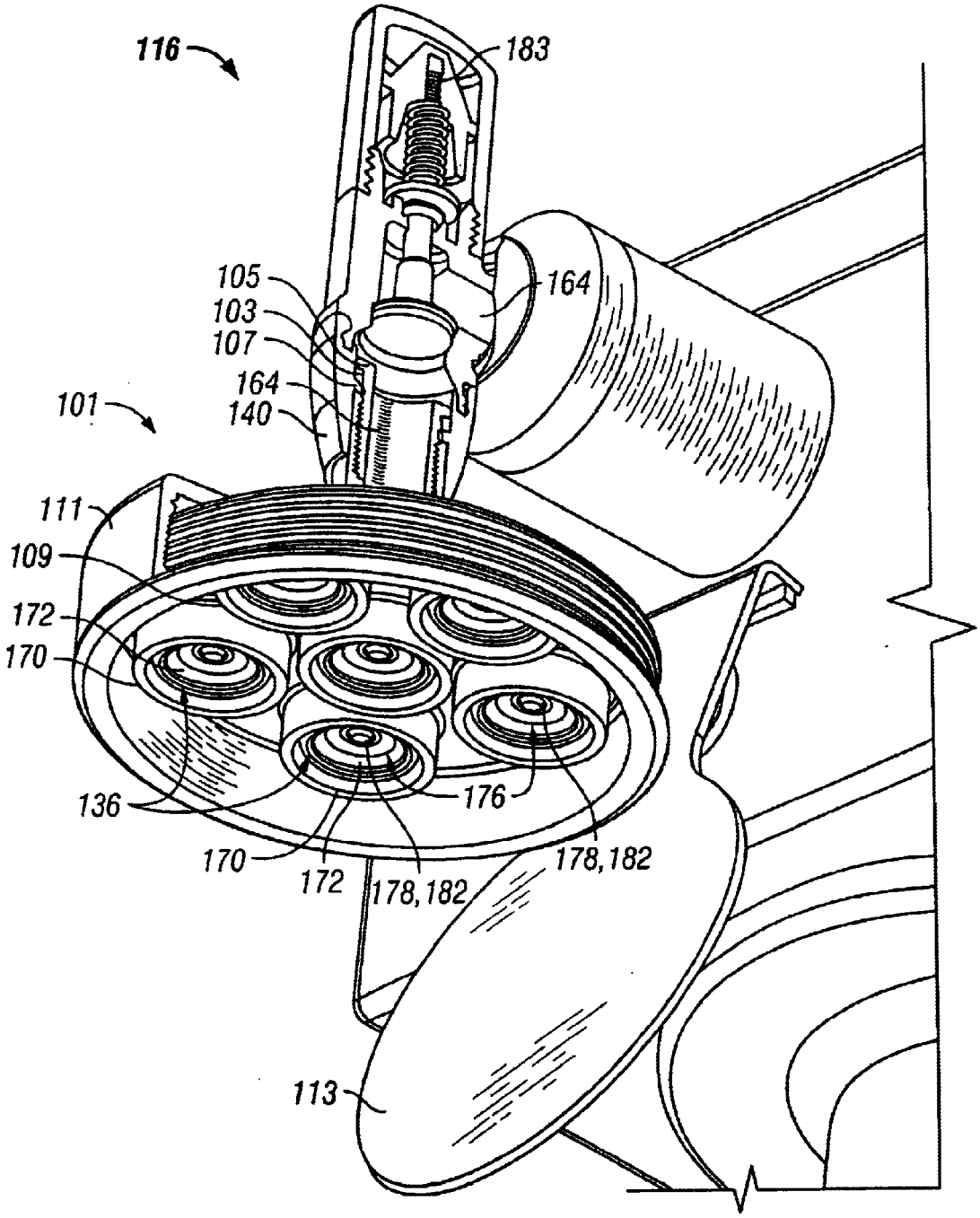
FIG. 10 is a partially cross-sectioned bottom perspective view of the comestible fluid dispensing tap illustrated in FIG. 9.

With reference to the tap embodiment illustrated in FIGS. 9 and 10, it should be noted that the advantages of the present invention are found in taps having significantly different shapes and sizes. The tap 116 illustrated in FIGS. 9 and 10 preferably employs the same elements and structure as described above with reference to the tap 16 of the first preferred embodiment, with the exception of the cutoff valve 176 location (and the location of the apertured shield 172). Specifically, the tap 116 preferably includes a spout 101 which is connected to the tap body 132 by a spout connector 103. The spout connector 103 is preferably received within and extends downstream from the nozzle portion 140 of the tap body 132. The spout 101 can be of any desired shape or size and can have any number and arrangement of comestible fluid outlets and internal comestible fluid lines. For example, the spout 101 illustrated in FIGS. 9 and 10 is a patterning spout having multiple comestible fluid outlets 136, and can be used for dispensing condiment on a bun or other food surface. Other spout types can be used for different patterns, shapes, and manners of comestible fluid delivery.

The spout connector 103 and spout 101 can be connected in any conventional manner, such as by one or more conventional fasteners such as screws, rivets, or clips, by a snap or press fit, by a threaded connection such as that shown in FIGS. 9 and 10, and the like. In some highly preferred embodiments, the spout connector 103 has a lip 105 which abuts an internal tongue 107 of the tap body 132 to keep the spout connector 103 within the tap body 132. Removal of this spout connector 103 is preferably performed by disconnecting a nozzle portion 140 from the remainder of the tap body 132 and by removing the spout connector 103 from the upstream side of the nozzle portion 140. For increased part interchangeability, the internal tongue 107 is preferably the same tongue used to releasably secure the apertured shield 72 in place within the tap body 32 as described above. In this regard, the spout connector 103 can be connected to the tap body 132 in any of the manners described above with reference to the apertured shield 72, cutoff valve seat 78, and separate tubular element passage 50 connections to the tap body 32. It should also be noted that the spout connector 103 can be connected in any such manner to the inside of the tap body 132 as shown or to the outside of the tap body 132.

Although it is highly preferred to connect the spout 101 to the tap body 132 by using a spout connector 103 (thereby requiring no modification to the tap body 32 of the first preferred embodiment described above), in some embodiments the spout 101 can be connected directly to the tap 16. Specifically, the spout 101 can have a threaded interior or exterior for connection to a threaded exterior or interior, respectively, of the tap body 132. As another example, the spout 101 can be directly connected to the tap body 132 by snap or press fits, by clips, buckles, or conventional fasteners, or by any other conventional mechanical fluid connection. If desired, the spout 101 can even be made integral with the tap body 32 or a portion (e.g., nozzle portion 140) thereof.

The spout 101 illustrated in FIGS. 9 and 10 preferably has multiple comestible fluid outlets 136, each one of which is preferably in fluid communication with the comestible fluid line 164 in the tap 16. Preferably, each comestible fluid outlet 136 has an apertured shield 172 that is similar to and functions in a similar manner to the apertured shield 72 of the first preferred embodiment. More preferably, the apertured shield 172 of each comestible fluid outlet 136 is part of a cutoff valve 176 that is also similar to and functions in a similar manner to the cutoff valve 76 of the first preferred embodiment. In this regard, the apertured shields 172 and the cutoff valves 176 are preferably connected within respective outlets 136 of the spout 101 in the same manner as the apertured shield 72 and cutoff valve 76 are connected to the comestible fluid nozzle 70 of the first preferred embodiment. If desired, each outlet 136 can be defined by a nozzle 170 extending from the apertured shield 172 and cutoff valve 176.

In some highly preferred embodiments such as that shown in FIGS. 9 and 10, the outlets 136 of the spout 101 are connected together to be removed from the spout 101 for replacement with another set of outlets 136. Specifically, the outlets 136 can all be located in a common plate 109 or other member defining part of the spout 101. The plate 109 can be releasably connected to the spout 101 in any conventional manner, but is preferably connected thereby by a threaded connection between the peripheral edge of the plate 109 and inside threads of the spout body 111 as shown in FIGS. 9 and 10. Alternatively, the plate 109 can be part of a cap having internal threads that mate with external threads on the outside wall of the spout body 111. The plate 109 can instead be releasably connected to the spout body 111 by one or more screws, clips, or other conventional fasteners, by being press-fit or snap-fit to the spout body 111, and the like. In those cases where a releasable connection is not needed or desired, the plate 109 can even be permanently connected or integral to the spout body 111. Still other manners of connecting the plate 109 to the spout body 111 are possible and would be recognized by one having ordinary skill in the art.

A detachable and removable plate 109 provides significant advantages to the spout 101 and tap 116 of the present invention because it permits interchangeability of the plate 109 with other plates 109 having different numbers, sizes, and patterns of outlets 136, nozzles 170, apertured shields 172 (with different aperture sizes), and cutoff valves 176. For example, the illustrated plate 109 can be removed and replaced with a plate having any number of outlets 136 desired, can be replaced with a plate having a plurality of apertured shields 172 with different resistances to deformation as described in more detail above, or can be replaced with a plate having outlets 136 arranged in a grid or other pattern.

Some preferred embodiments of the present invention can employ a trigger lever 113 adjacent to the tap 16, 116 for actuation of a powered comestible fluid pump 12. The trigger lever 113 is preferably electrically connected to the pump or to the motor, actuator, or other driving device driving the pump 12. When the trigger lever 113 is actuated, one or more signals can be transmitted to the pump 12 or to the pump motor, actuator, or other driving device to pump comestible fluid to the tap 16, 116. The trigger lever 113 is also preferably biased to an unactuated position in any conventional manner (e.g., by one or more springs, gas springs, solenoids, pneumatic or hydraulic cylinders, and other conventional actuators). Therefore, in some embodiments, release of the trigger lever 113 preferably stops the pump, pump motor, actuator, or other driving device to stop the flow of comestible fluid from the tap 16, 116. In other preferred embodiments, the trigger lever 113 is connected to a conventional controller that transmits one or more signals to the pump 12 or to the pump motor, actuator, or other driving device to pump comestible fluid to the tap. In some highly preferred embodiments, this driving device is operated under control of the controller for a timed period regardless of whether the user releases the trigger lever 113.

It should be noted that in those cases where a pump is not employed to transport the comestible fluid to the tap 16, 116, such as in a free-flow or pressurized system, the trigger lever 113 can instead be connected to a conventional valve. Opening and closure of the valve thereby also causes comestible fluid to start and stop flowing as just described.

In non-manually operated dispensing systems (such as systems employing a powered pump 12 and/or powered valves), the dispensing system can be triggered to dispense condiment in a number of different manners. For example, a conventional mechanical switch, trigger, lever, button, or other control can be tripped by the user to drive the pump 12 and/or open the valve 48, 15 to dispense condiment. Alternatively, one or more optical or other conventional sensors can be positioned to detect a vessel or surface upon or within which condiment is to be dispensed. Upon detecting the vessel or surface, the sensor(s) can trigger activation of the pump and/or can open the valve 48, 15 to dispense condiment. The above-described controls and sensors for operating the dispensing system 10 are connected to a conventional controller or can be connected directly to the elements to be driven or actuated. Such controls, sensors, controllers, and their manner of connection and operation are well known in the art and are not therefore described further herein.

As mentioned above, the dispensing system 10 of the illustrated preferred embodiment employs a hand pump 12 for pumping comestible fluid to the tap 16. As also described above, the hand pump 12 can take a number of different forms, including a manually-operated version of the pump disclosed in U.S. Pat. No. 5,992,695 issued to Start. With reference to FIG. 2, the pump 12 can have a pump body 11 defining a pump chamber 13 therein. Preferably, the user-actuatable plunger 14 is connected to a valve 15 that is movable within the pump chamber 13 to pump comestible fluid from the comestible fluid pump outlet 28 to the tap 16. Although a number of different valve types can be employed to perform this function (such as those described above with reference to the tap valve 48) the pump valve 15 preferably operates in conjunction with a valve collar 17 movable in the pump chamber 13.

Preferably, the valve collar 17 is shaped with respect to the pump valve 15 to prevent comestible fluid flow past the valve collar 17 and pump valve 15 when the pump valve 15 is seated with respect to the valve collar 17 as described in greater detail below (i.e., when the pump valve 15 is in a closed position). It should be noted that a closed position of the pump valve 15 is preferably defined in the same manner as a closed position of the tap valve 48 described above. In some highly preferred embodiments such as that shown in the figures, the valve collar 17 is annular in shape and is in sliding relationship within the pump chamber 13. The valve collar 17 is preferably movable along the internal walls of the pump chamber 13 and prevents comestible fluid flow past the pump valve 15 and valve collar 17 when the pump valve 15 is in a closed position (whether between the valve collar 17 and the pump chamber walls or between the valve collar 17 and the pump valve 15).

The valve collar 17 is preferably connected to the pump valve 15 so that the valve collar 17 can move in both directions in the pump chamber 13 with movement of the pump valve 15. With continued reference to FIG. 2, one manner of connecting the valve collar 17 to the pump valve 15 is by a retaining element 19 connected to the pump valve 15. Specifically, the retaining element 19 is preferably connected to the pump valve 15 either directly or by an valve rod extension 21 as illustrated. In the latter case, the valve rod extension 21 can be connected to the pump valve 15 and to the retaining element 19 in any conventional manner, such as by being press-fit together, by adhesive or other bonding material, by threaded connections, by welding or brazing, and the like. In other embodiments, any two or more of these three elements can be integrally formed as one element. The retaining element can take any shape capable of retaining the valve collar 17 on the plunger 14, such as the round shape illustrated in the figures, a bar-shaped element across the valve collar 17, and the like.

The valve collar 17 is preferably connected to the plunger 14 with an amount of lost-motion, thereby permitting the relative motion between the pump valve 15 and the valve collar 17 as described in U.S. Pat. No. 5,992,695 issued to Start. With this lost motion, when the pump valve 15 is actuated, the pump valve 15 preferably moves relative to the valve collar 17 until it abuts a valve seat 21 of the valve collar 17. Thereafter, continued actuation of the pump valve 15 moves the pump valve 15 and valve collar 17 together to force comestible fluid out of the pump chamber 13.

Preferably, the plunger 14 can be further actuated until a plunger stop 23 halts further actuation of the plunger 14 or when the pump valve 15 and valve collar 17 reach the end of the pump chamber 13. The plunger stop 23 can take several different forms, including without limitation a collar on a threaded body portion of the pump 12 (see FIG. 2), one or more pins received in one or more apertures along the body portion of the pump 12, one or more clips on the body portion of the pump, one or more ribs, bumps, walls, or other protrusions on the body portion of the pump 12, and the like. Alternatively, any of these elements can instead be located on the plunger 14 to limit plunger movement with respect to the body of the pump 12.

Although not required, the plunger stop 23 is preferably adjustable to different locations on the pump 12 to permit different strokes of the plunger 14 (and therefore, different amounts of comestible fluid dispense per plunger stroke). For example, the collar 23 can be threaded up or down the body of the pump 12, a pin can be inserted in different apertures on the body of the pump 12, and clips can be released and re-attached at different locations along the body of the pump 12. Still other manners of adjusting plunger movement are possible and fall within the spirit and scope of the present invention. Some such alternatives are disclosed in U.S. Pat. No. 5,992,695 issued to Start.

After the plunger 14 has been fully actuated or actuated to a desired extent, the plunger 14 preferably retracts toward its unactuated position. In the illustrated preferred embodiment, this retraction is caused by force from a plunger spring 25 acting upon the plunger 14. Other biasing elements (e.g., magnets, an air spring, elastic elements, and the like) connected to the plunger 14 can instead be used to retract the plunger 14. When the plunger retracts from its actuated position shown in FIG. 3, the retaining element 19 preferably pulls the valve collar 17 through the pump chamber 13 with the pump valve 15.

Although the pump valve 15 can be of any type having any shape and form capable of opening and closing (to control fluid flow past the pump valve 15), the pump valve 15 is preferably a draw-back valve capable of exerting force in an upstream direction upon comestible fluid located downstream of the pump valve 15. Any type of draw-back valve can be used for this purpose, including those described above with reference to the tap valve 48. However, some highly preferred embodiments employ the same or a similar valve as that used for the tap valve 48.

With reference again to FIGS. 2 and 3, the pump valve 15 and valve collar 17 are preferably similar in structure and operation to the tap valve 48 and the inner walls of the tap body 32 which define the comestible fluid passage 50 of the tap 16. In particular, when the pump valve 15 retracts from an actuated position such as that shown in FIG. 2, the pump valve 15 preferably passes through a fluid passage 27 in the valve collar 17. The valve collar 17 and fluid passage 27 can take any shape described above with reference to the fluid passage 50 of the tap valve 48. Like the fluid passage 50 of the tap valve 48, the fluid passage 27 of the valve collar 17 preferably has a throat 29 with a constant or substantially constant cross-sectional area. Movement of the pump valve 15 through this throat 29 therefore preferably generates a suck-back force upon downstream comestible fluid. Also like the fluid passage 50 of the tap valve 48, the fluid passage 27 of the valve collar 17 can have converging or diverging upstream and/or downstream passage portions (such as those illustrated in FIGS. 2 and 3).

The discussion above with reference to the features, structure, and alternatives of the tap valve 48 and the comestible fluid passage 50 apply equally to the valve collar 17 and the pump valve 15. However, the arrangement of the valve collar 17 and the pump valve 15 is an example of how the desired draw-back force can be generated by valve movement during valve closure or opening. In this regard, and with reference to the illustrated preferred embodiment, it should be noted that the draw-back force in the pump 12 is created by movement of the pump valve 15 from its closed position to its opened position, while the draw-back force in the tap 16 is created by movement of the tap valve 48 from its opened position to its closed position. The draw-back valve of the present invention can therefore exert a draw-back force in either direction of valve movement (e.g., depending at least partially upon the orientation of the valve and cooperating adjacent walls).

Various embodiments of the present invention can employ a draw-back valve in the tap 16, in the pump 12, or in both the tap 16 and the pump 12 as illustrated in the figures. In those embodiments employing a draw-back valve in the tap 16 and pump 12, the draw-back valves can cooperate by operating at the same time or in a staggered relationship with one another. By way of example only, the tap valve 48 can close during or after the pump valve 15 following each actuation of the pump 12 in the illustrated preferred embodiment. This valve closure sequence can enable the pump valve 15 to assist the tap valve 48 in its draw-back function.

In some cases, it may be desirable to increase the draw-back force exerted within the tap 16, 116. Some manners of increasing draw-back force are described above with reference to the valve 48 and the fluid passage through which the valve 48 moves. Another manner of increasing draw-back force is to include multiple draw-back valves 48 in series along the comestible fluid line 64 in the tap 16, 116. These multiple draw-back valves 48 can operate in any order, such as by closing simultaneously or in succession. For example, two or more valves 48 can be connected to the same valve rod 83 and can pass through respective throats 50 at the same time or in succession (e.g., the farthest upstream valve 48 passing through its throat 50 first relative to the other valves 48, and so forth). Two or more valves 48 can be connected together in any manner, such as by rods connected at each end to successive valves 48 in the tap body 32. As another example, multiple valves 48 can be independently controlled to close in any desired order by dedicated valve driving devices or by dedicated pneumatics or hydraulics (described earlier) controlled in a conventional manner. Where multiple valves 48 are employed, each valve 48 can assist in the closure of downstream valves 48.

As noted above, the draw-back tap valve(s) 48 of the present invention can be located anywhere in the tap 16, 116. In addition, one or more draw-back valves 48 can be located in downstream elements connected to the tap, such as the spout 101 in the preferred embodiment illustrated in FIGS. 9 and 10. For example, a large valve 48 can be located in the spout body 111 upstream of the spout plate 109. This large valve 48 can move within the spout body 111 to generate a draw-back force upon downstream comestible fluid in a manner similar to the valve 48 within the tap body 32. Like the tap valve 48 within the tap body 32, this spout valve can extend to the walls of the spout body 111 or can be smaller than the spout body 111 while still generating a desired draw-back force. A significant advantage of employing a larger valve in the spout 101 as described above is the relatively large draw back force provided by such a valve due to its larger diameter and the larger amount of volume drawn by movement thereof. This spout valve can be connected to an upstream valve 48, or can be movable independently of other draw-back valves 48. In some preferred embodiments, the draw-back valve 48 in the tap body 32 is replaced by a draw-back valve in the spout 101 or other device connected to the tap 116. Accordingly, the draw-back valve of the present invention can be located at any position in the tap 16, 116 or in a downstream device connected thereto.

The dispensing system 10 described above and illustrated in the figures employs a manually-operated pump 12 and a manually-operated tap 16. However, either one or both of these devices can be automatically operated in different embodiments. By way of example only, the manually-operated pump 12 can be replaced with a pump that is pneumatically or hydraulically driven, a pump that is driven by a motor, solenoid, magnet set, or a pump driven in any other conventional manner. One such pump is disclosed in U.S. Pat. No. 5,992,695 issued to Start, the disclosure of which is hereby incorporated by reference insofar as it relates to powered pumps, pump driving systems, pump valves, and their operation. In one alternative embodiment, the pump 12 of the present invention can be replaced by the pump disclosed in the Start patent.

In some embodiments, the tap 16 can also be pneumatically or hydraulically driven, driven by a motor, solenoid, magnet set, or in any other conventional manner. With reference to FIGS. 6–8 for example, a pneumatic or hydraulic line can be connected in a conventional manner to a port in the damper portion 42 of the tap body 32, and can therefore increase or decrease pressure in the damper chamber 94 to move the valve rod 83 and the valve 48 connected thereto. Alternatively, the pump structure disclosed in the Start patent can be employed in the tap 16 if desired.

In still other embodiments of the present invention, the draw-back valves 48, 15 can be connected to a motor by a lead screw, by a rack, or in any other conventional manner, can be driven directly by a hydraulic, pneumatic, or electrical solenoid connected to the valve 48, 15, and the like. One having ordinary skill in the art will appreciate that other manners of powering the valves 48, 15 to their open and/or closed positions are possible as alternatives to the manually-driven valves of the illustrated preferred embodiment, each one of which falls within the spirit and scope of the present invention.

The dispensing system 10 described above and illustrated in the figures is adapted for use on a countertop, table, or similar structure. It should be noted, however, that the present invention can be used as an under-counter system or in any other environment. In this regard, the self-contained structure of the preferred dispensing system 10 best shown in FIGS. 1–3 can be adapted in any manner desired. By way of example only, in those embodiments having a tap 16 and a pump 12, the tap 16 and pump 12 can be separated by any desired distance and need not necessarily be connected to a common housing or frame.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, although the embodiments of the tap 16, 116 described above and illustrated in the figures each have one fluid line 64 through which condiment flows to the tap outlet(s) 36, 136, other embodiments of the present invention can employ multiple comestible fluid lines 64 running to respective tap outlets 36, 136, wherein each fluid line 64 has one or more draw-back valves 48. A housing can enclose the separate fluid lines 64 and tap outlets 36, 136. With this system, multiple types of condiment can be dispensed through dedicated fluid lines 64—at least one fluid line 64 for each type of condiment. If desired, the fluid lines 64 for each type of condiment can be connected to respective pumps and/or valves that can be independently controlled in a conventional manner to dispense all condiments simultaneously or only those condiments selected for dispense by a user. Most preferably, conventional controls can be connected to the pumps or other driving devices or to the valves so that a user can select any one or more condiments to be dispensed.

It should be noted that throughout the appended claims, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. Examples include directly securing one element to another (e.g., via welding, bolting, gluing, frictionally engaging, mating, etc.), elements which can act upon one another (e.g., via camming, pushing, or other interaction), one element imparting motion directly or through one or more other elements to another element, and one element electrically connected to another element either directly or through a third element.

As used herein and in the appended claims, the term "fluid line" refers to any conduit through which comestible fluid is transported, and unless otherwise stated is independent of the length, diameter, material, flexibility or inflexibility, shape, or other conduit properties. Examples of fluid lines include tubing, hose, pipe, interior cavities of solid elements, and the like made of plastic, nylon, PVC, copper, steel, aluminum, or other material.

Comestible fluid flow is described herein and in the appended claims as being "through" or "past" various elements (such as a valve or a wall). These terms are considered to be synonymous and are not intended as a limitation upon the type, shape, or position of the element with respect to the comestible fluid. Comestible fluid flow "past" or "through" an element only means that the comestible fluid can move from an upstream position with respect to the element to a downstream position with respect to the element, and can do so by moving through, around, past, beside, or in any other manner with respect to the element.

I claim:

1. A comestible fluid dispensing tap, comprising:

a tap body;

a comestible fluid inlet through which comestible fluid is received into the body;

a comestible fluid outlet through which comestible fluid is discharged from the body;

a draw-back valve located at least one of within the tap body and immediately upstream of the tap body;

a comestible fluid passage through which comestible fluid can pass to the comestible fluid outlet and along which the draw-back valve is movable, the comestible fluid passage defined by at least one internal wall, the draw-back valve being movable between an open position through a range of intermediate positions in the comestible fluid passage to a closed position;

a wall in the body located between the draw-back valve and the comestible fluid outlet and having at least one aperture through which comestible fluid passes to the comestible fluid outlet;

the draw-back valve having a light clearance fit in the at least one internal wall of the comestible fluid passage and in at least part of the range of intermediate positions of the valve to generate suction force through the comestible fluid outlet from movement of the draw-back valve toward the closed position.

2. The comestible fluid dispensing tap as claimed in claim 1, wherein the valve is a plunger valve.

3. The comestible fluid dispensing tap as claimed in claim 2, wherein the plunger valve has a round shape substantially matching a cross-sectional shape of the comestible fluid passage.

4. The comestible fluid dispensing tap as claimed in claim 1, wherein the valve is substantially closed in at least a portion of the range of intermediate positions of the valve in the comestible fluid passage.

5. The comestible fluid dispensing tap as claimed in claim 1, wherein:

the valve has a peripheral edge movable along walls defining the comestible fluid passage; and the peripheral edge of the valve has a reduced thickness relative to non-peripheral portions of the valve.

6. The comestible fluid dispensing tap as claimed in claim 5, wherein the peripheral edge of the valve substantially closes the valve in at least a portion of the range of intermediate positions of the valve.

7. The comestible fluid dispensing tap as claimed in claim 1, wherein the comestible fluid passage includes a throat having a substantially constant cross sectional area.

8. The comestible fluid dispensing tap as claimed in claim 7, wherein the throat of the passage has a substantially constant diameter.

9. The comestible fluid dispensing tap as claimed in claim 7, wherein the comestible fluid passage further includes a portion downstream of the throat and having an increasing cross-sectional area toward the comestible fluid outlet.

10. The comestible fluid dispensing tap as claimed in claim 9, wherein:

the valve is movable in at least part of the downstream portion of the comestible fluid passage; and the open position of the valve is in the downstream portion of the comestible fluid passage.

11. The comestible fluid dispensing tap as claimed in claim 1, wherein the comestible fluid passage further includes a portion having an increasing cross-sectional area toward the comestible fluid outlet.

12. The comestible fluid dispensing tap as claimed in claim 11, wherein: the valve is movable in at least part of the comestible fluid passage portion; and the open position of the valve is in the comestible fluid passage portion.

13. The comestible fluid dispensing tap as claimed in claim 1, wherein the comestible fluid passage is at least partially defined by a tubular element received within the body.

14. The comestible fluid dispensing tap as claimed in claim 13, wherein the tubular element has a varying cross sectional area.

15. The comestible fluid dispensing tap as claimed in claim 1, further comprising a fluid chamber defined in part by a chamber wall coupled to the valve, the chamber wall and the valve connected thereto movable by changes of comestible fluid pressure in the tap.

16. The comestible fluid dispensing tap as claimed in claim 15, wherein the valve is a plunger valve coupled to the movable chamber wall by a valve rod.

17. The comestible fluid dispensing tap as claimed in claim 1, wherein the apertured wall is resiliently deformable under pressure of comestible fluid in the tap.

18. The comestible fluid dispensing tap as claimed in claim 17, wherein the apertured wall is resiliently deformable by suction from valve closure to dislodge comestible fluid on the apertured wall.

19. The comestible fluid dispensing tap as claimed in claim 17, wherein the apertured wall is part of a cutoff valve, the cutoff valve further comprising a valve seat adjacent to the apertured wall, the apertured wall resiliently deformable between a seated position on the valve seat in which the cutoff valve is closed to passage of comestible fluid and an unseated position in which the cutoff valve is open to passage of comestible fluid.

20. The comestible fluid dispensing tap as claimed in claim 1, wherein the apertured wall is part of a cutoff valve, the cutoff valve further comprising a valve seat adjacent to the apertured wall, the apertured wall movable between a seated position on the valve seat in which the cutoff valve is closed to passage of comestible fluid and an unseated position in which the cutoff valve is open to passage of comestible fluid.

21. The comestible fluid dispensing tap as claimed in claim 1, wherein the comestible fluid outlet is at least partially defined by a skirt extending downstream from the valve.

22. The comestible fluid dispensing tap in claim 1, wherein the valve is located in the tap body.

23. The comestible fluid dispensing tap in claim 1, wherein at least a portion of the valve is located in the tap body.

24. A comestible fluid dispensing tap, comprising:

a dispensing tap body;

a comestible fluid inlet;

a comestible fluid outlet;

a draw-back valve located at least one of within the dispensing tap body and immediately upstream of the dispensing tap body and having an open position in which comestible fluid can flow in a first direction past the draw-back valve and out of the comestible fluid outlet; and a closed position in which comestible fluid does not flow past the draw-back valve and out of the comestible fluid outlet, the draw-back valve movable from the open position to the closed position to draw comestible fluid in a reverse direction through the comestible fluid outlet toward the draw-back valve; and an apertured wall located between the valve and the comestible fluid outlet and through which comestible fluid passes from the valve to the comestible fluid outlet.

25. The comestible fluid dispensing tap as claimed in claim 24, wherein the draw-back valve is movable within a comestible fluid passage located upstream of the comestible fluid outlet.

26. The comestible fluid dispensing tap as claimed in claim 25, wherein the draw-back valve is a plunger valve.

27. The comestible fluid dispensing tap as claimed in claim 25, wherein the draw-back valve is movable through a range of substantially closed positions in the comestible fluid passage.

28. The comestible fluid dispensing tap as claimed in claim 24, further comprising a comestible fluid passage in which the draw-back valve is movable between its open and closed positions.

29. The comestible fluid dispensing tap as claimed in claim 28, wherein the comestible fluid passage includes a throat having a substantially constant cross-sectional area.

30. The comestible fluid dispensing tap as claimed in claim 28, wherein at least a portion of the comestible fluid passage has an increasing cross-sectional area toward the comestible fluid outlet.

31. The comestible fluid dispensing tap as claimed in claim 30, wherein another portion of the comestible fluid passage has a substantially constant cross-sectional area.

32. The comestible fluid dispensing tap as claimed in claim 28, further comprising a tap body at least partially defining the comestible fluid outlet, wherein the comestible fluid passage is a generally tubular element received within the tap body.

33. The comestible fluid dispensing tap as claimed in claim 24, further comprising a fluid chamber partially defined by a wall coupled to the draw-back valve, the wall and the draw-back valve coupled thereto movable by comestible fluid pressure changes.

34. The comestible fluid dispensing tap as claimed in claim 33, wherein the draw-back valve is coupled to the movable wall by a valve rod.

35. The comestible fluid dispensing tap as claimed in claim 24, wherein the apertured wall is resiliently deformable.

36. The comestible fluid dispensing tap as claimed in claim 35, wherein the apertured wall is responsive to suction from valve closure by deforming to dislodge comestible fluid from the apertured wall.

37. The comestible fluid dispensing tap as claimed in claim 35, wherein the resiliently deformable apertured wall is part of a cutoff valve, the cutoff valve further comprising a valve seat upon which the resiliently deformable apertured wall can seat to close the cutoff valve against comestible fluid passage to the comestible fluid outlet.

38. The comestible fluid dispensing tap as claimed in claim 24, wherein the apertured wall is part of a cutoff valve, the cutoff valve further comprising a valve seat upon which the apertured wall can seat to close the cutoff valve against comestible fluid passage to the comestible fluid outlet.

39. The comestible fluid dispensing tap as claimed in claim 24, wherein the comestible fluid outlet is at least partially defined by a skirt extending downstream of the draw-back valve.

40. The comestible fluid dispensing tap in claim 24, wherein the draw-back valve is located in the tap body.

41. The comestible fluid dispensing tap in claim 24, wherein at least a portion of the draw-back valve is located in the tap body.

42. A comestible fluid dispensing tap, comprising:

a tap body;

a comestible fluid inlet through which comestible fluid is received into the body;

a comestible fluid outlet through which comestible fluid is discharged from the body;

a draw-back valve located at least one of within the tap body and immediately upstream of the tap body, the draw-back valve having an upstream end; and an enlarged downstream end; and a comestible fluid passage through which comestible fluid can pass to the comestible fluid outlet and along which the draw-back valve is movable, the comestible fluid passage defined by at least one internal wall, the draw-back valve being movable between an open position through a range of intermediate positions in the comestible fluid passage to a closed position, the enlarged downstream end of the draw-back valve having a light clearance fit in the at least one internal wall of the comestible fluid passage and in at least part of the range of intermediate positions of the valve to generate suction force downstream of the valve in movement of the valve toward the closed position, the draw-back valve movable to a position in which the enlarged downstream end is seated with respect to a wall of the tap body to seal the comestible fluid passage against flow of comestible fluid past the draw-back valve.

43. The comestible fluid dispensing tap as claimed in claim 42, wherein the valve is a plunger valve.

44. The comestible fluid dispensing tap as claimed in claim 43, wherein the plunger valve has a round shape substantially matching a cross-sectional shape of the comestible fluid passage.

45. The comestible fluid dispensing tap as claimed in claim 42, wherein the valve is substantially closed in at least a portion of the range of intermediate positions of the valve in the comestible fluid passage.

46. The comestible fluid dispensing tap as claimed in claim 42, wherein:

the valve has a peripheral edge movable along walls defining the comestible fluid passage; and the peripheral edge of the valve has a reduced thickness relative to non-peripheral portions of the valve.

47. The comestible fluid dispensing tap as claimed in claim 46, wherein the peripheral edge of the valve substantially closes the valve in at least a portion of the range of intermediate positions of the valve.

48. The comestible fluid dispensing tap as claimed in claim 42, wherein the comestible fluid passage includes a throat having a substantially constant cross sectional area.

49. The comestible fluid dispensing tap as claimed in claim 48, wherein the throat of the passage has a substantially constant diameter.

50. The comestible fluid dispensing tap as claimed in claim 48, wherein the comestible fluid passage further includes a portion downstream of the throat and having an increasing cross-sectional area toward the comestible fluid outlet.

51. The comestible fluid dispensing tap as claimed in claim 50, wherein:

the valve is movable in at least part of the downstream portion of the comestible fluid passage; and the open position of the valve is in the downstream portion of the comestible fluid passage.

52. The comestible fluid dispensing tap as claimed in claim 42, wherein the comestible fluid passage further includes a portion having an increasing cross-sectional area toward the comestible fluid outlet.

53. The comestible fluid dispensing tap as claimed in claim 52, wherein: the valve is movable in at least part of the comestible fluid passage portion; and the open position of the valve is in the comestible fluid passage portion.

54. The comestible fluid dispensing tap as claimed in claim 42, wherein the comestible fluid passage is at least partially defined by a tubular element received within the body.

55. The comestible fluid dispensing tap as claimed in claim 54, wherein the tubular element has a varying cross sectional area.

56. The comestible fluid dispensing tap as claimed in claim 42, further comprising a fluid chamber defined in part by a chamber wall coupled to the valve, the chamber wall and the valve connected thereto movable by changes of comestible fluid pressure in the tap.

57. The comestible fluid dispensing tap as claimed in claim 56, wherein the valve is a plunger valve coupled to the movable chamber wall by a valve rod.

58. The comestible fluid dispensing tap as claimed in claim 42, further comprising a wall in the body located between the valve and the comestible fluid outlet and having at least one aperture through which comestible fluid passes to the comestible fluid outlet.

59. The comestible fluid dispensing tap as claimed in claim 58, wherein the apertured wall is resiliently deformable under pressure of comestible fluid in the tap.

60. The comestible fluid dispensing tap as claimed in claim 59, wherein the apertured wall is resiliently deformable by suction from valve closure to dislodge comestible fluid on the apertured wall.

61. The comestible fluid dispensing tap as claimed in claim 59, wherein the apertured wall is part of a cutoff valve, the cutoff valve further comprising a valve seat adjacent to the apertured wall, the apertured wall resiliently deformable between a seated position on the valve seat in which the cutoff valve is closed to passage of comestible fluid and an unseated position in which the cutoff valve is open to passage of comestible fluid.

62. The comestible fluid dispensing tap as claimed in claim 58, wherein the apertured wall is part of a cutoff valve, the cutoff valve further comprising a valve seat adjacent to the apertured wall, the apertured wall movable between a seated position on the valve seat in which the cutoff valve is closed to passage of comestible fluid and an unseated position in which the cutoff valve is open to passage of comestible fluid.

63. The comestible fluid dispensing tap as claimed in claim 42, wherein the comestible fluid outlet is at least partially defined by a skirt extending downstream from the valve.

64. A comestible fluid dispensing tap, comprising:

a dispensing tap body;

a comestible fluid inlet;

a comestible fluid outlet; and a draw-back valve located at least one of within the dispensing tap body and immediately upstream of the dispensing tap body, the draw-back valve having a body terminating in a free downstream end movable in and with respect to the dispensing tap body;

an open position in which comestible fluid can flow in a first direction past the free downstream end of the draw-back valve and out of the comestible fluid outlet; and a closed position in which the free downstream end of the draw-back valve blocks comestible fluid from passing the free downstream end of the draw-back valve, the free downstream end of the draw-back valve movable from the open position to the closed position to draw comestible fluid in a reverse direction through the comestible fluid outlet toward the draw-back valve.

65. The comestible fluid dispensing tap as claimed in claim 64, wherein the draw-back valve is movable within a comestible fluid passage located upstream of the comestible fluid outlet.

66. The comestible fluid dispensing tap as claimed in claim 65, wherein the draw-back valve is a plunger valve.

67. The comestible fluid dispensing tap as claimed in claim 65, wherein the draw-back valve is movable through a range of substantially closed positions in the comestible fluid passage.

68. The comestible fluid dispensing tap as claimed in claim 64, further comprising a comestible fluid passage in which the draw-back valve is movable between its open and closed positions.

69. The comestible fluid dispensing tap as claimed in claim 68, wherein the comestible fluid passage includes a throat having a substantially constant cross-sectional area.

70. The comestible fluid dispensing tap as claimed in claim 68, wherein at least a portion of the comestible fluid passage has an increasing cross-sectional area toward the comestible fluid outlet.

71. The comestible fluid dispensing tap as claimed in claim 70, wherein another portion of the comestible fluid passage has a substantially constant cross-sectional area.

72. The comestible fluid dispensing tap as claimed in claim 68, further comprising a tap body at least partially defining the comestible fluid outlet, wherein the comestible fluid passage is a generally tubular element received within the tap body.

73. The comestible fluid dispensing tap as claimed in claim 64, further comprising a fluid chamber partially defined by a wall coupled to the draw-back valve, the wall and the draw-back valve coupled thereto movable by comestible fluid pressure changes.

74. The comestible fluid dispensing tap as claimed in claim 73, wherein the draw-back valve is coupled to the movable wall by a valve rod.

75. The comestible fluid dispensing tap as claimed in claim 64, further comprising an apertured wall located between the valve and the comestible fluid outlet and through which comestible fluid passes from the valve to the comestible fluid outlet.

76. The comestible fluid dispensing tap as claimed in claim 75, wherein the apertured wall is resiliently deformable.

77. The comestible fluid dispensing tap as claimed in claim 76, wherein the apertured wall is responsive to suction from valve closure by deforming to dislodge comestible fluid from the apertured wall.

78. The comestible fluid dispensing tap as claimed in claim 76, wherein the resiliently deformable apertured wall is part of a cutoff valve, the cutoff valve further comprising a valve seat upon which the resiliently deformable apertured wall can seat to close the cutoff valve against comestible fluid passage to the comestible fluid outlet.

79. The comestible fluid dispensing tap as claimed in claim 75, wherein the apertured wall is part of a cutoff valve, the cutoff valve further comprising a valve seat upon which the apertured wall can seat to close the cutoff valve against comestible fluid passage to the comestible fluid outlet.

80. The comestible fluid dispensing tap as claimed in claim 64, wherein the comestible fluid outlet is at least partially defined by a skirt extending downstream of the draw-back valve.

* * * * *